US009904247B2

(12) United States Patent
Ogino et al.

(10) Patent No.: US 9,904,247 B2
(45) Date of Patent: Feb. 27, 2018

(54) COOLING DEVICE AND IMAGE FORMING APPARATUS INCORPORATING THE COOLING DEVICE

(71) Applicants: Takahiro Ogino, Kanagawa (JP); Kazuhiro Shimada, Kanagawa (JP)

(72) Inventors: Takahiro Ogino, Kanagawa (JP); Kazuhiro Shimada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/295,425

(22) Filed: Oct. 17, 2016

(65) Prior Publication Data

US 2017/0123373 A1 May 4, 2017

(30) Foreign Application Priority Data

Oct. 30, 2015 (JP) ..... 2015-214108
Oct. 30, 2015 (JP) ..... 2015-214109
Mar. 23, 2016 (JP) ..... 2016-058390
Mar. 23, 2016 (JP) ..... 2016-058394

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS 2,904,860 A * 9/1959 Hazelett ..... B22D 11/0605 164/431
2011/0030927 A1 2/2011 Okano et al.
2011/0052247 A1 3/2011 Saitoh et al.
2011/0052248 A1 3/2011 Nishimura et al.
2011/0052249 A1 3/2011 Iijima et al.
2011/0164896 A1 7/2011 Hirasawa et al.
2011/0170895 A1 7/2011 Fujiya et al.
2011/0188880 A1 8/2011 Suzuki et al.
2012/0061057 A1 3/2012 Okano et al.
2012/0070180 A1 3/2012 Iijima et al.
2012/0227927 A1 9/2012 Fujiya et al.
2012/0263491 A1 10/2012 Fujiya et al.
(Continued)

FOREIGN PATENT DOCUMENTS

JP 2008-064991 3/2008
JP 2011-227175 11/2011
(Continued)

*Primary Examiner* — G. M. Hyder
(74) *Attorney, Agent, or Firm* — Oblon, McClelland, Maier & Neustadt, L.L.P.

(57) ABSTRACT

A cooling device that is included in an image forming apparatus includes a first cooler configured to cool a first face of a recording medium and a second cooler configured to cool a second face of the recording medium. The first cooler includes a first heat absorbing face and a first liquid flowing passage. The first heat absorbing face is configured to contact an inner circumferential surface of a belt to face the first face of the recording medium. The second cooler includes a second heat absorbing face and a second liquid flowing passage. The second heat absorbing face is disposed facing the second face of the recording medium.

18 Claims, 20 Drawing Sheets

(56) References Cited

U.S. PATENT DOCUMENTS

| | | | | |
|---|---|---|---|---|
| 2012/0315069 | A1* | 12/2012 | Ikeda | G03G 15/0189 399/341 |
| 2013/0216242 | A1 | 8/2013 | Iijima | |
| 2013/0259512 | A1 | 10/2013 | Ikeda et al. | |
| 2014/0044462 | A1 | 2/2014 | Ikeda et al. | |
| 2014/0060782 | A1 | 3/2014 | Ikeda et al. | |
| 2014/0186080 | A1 | 7/2014 | Ikeda et al. | |
| 2014/0186081 | A1* | 7/2014 | Hirasawa | G03G 15/6573 399/341 |
| 2014/0233996 | A1* | 8/2014 | Ikeda | G03G 21/20 399/341 |
| 2014/0308058 | A1* | 10/2014 | Ikeda | G03G 15/6573 399/341 |
| 2014/0334858 | A1 | 11/2014 | Miyagawa et al. | |

FOREIGN PATENT DOCUMENTS

| | | |
|---|---|---|
| JP | 2011-227315 | 11/2011 |
| JP | 2012-098677 | 5/2012 |
| JP | 2014-219658 | 11/2014 |

* cited by examiner

COOLING DEVICE AND IMAGE FORMING APPARATUS INCORPORATING THE COOLING DEVICE

CROSS-REFERENCE TO RELATED APPLICATIONS

This patent application is based on and claims priority pursuant to 35 U.S.C. § 119(a) to Japanese Patent Application Nos. 2015-214108, filed on Oct. 30, 2015, 2015-214109, filed on Oct. 30, 2015, 2016-058390, filed on Mar. 23, 2016, and 2016-058394, filed on Mar. 23, 2016, in the Japan Patent Office, the entire disclosure of each of which is hereby incorporated by reference herein.

BACKGROUND

Technical Field

This disclosure relates to a cooling device to cool a recording medium and an image forming apparatus incorporating the cooling device.

Related Art

Image forming apparatuses are known to include a cooling device to cool a heated recording medium with a cooling unit using, for example, a heat pipe or a heat sink. Further, a cooling device is also known to have multiple cooling units disposed on both sides of a recording medium in order to cool both sides of the recording medium effectively. In this case, the multiple cooling units are located shifted to each other in a sheet conveying direction.

When multiple cooling units are employed in an image forming apparatus, the multiple cooling units have the same cooling method.

Depending on a cooling method, however, a cooling device needs a specified space to be installed. Therefore, it may be difficult to dispose multiple cooling units employing the same cooling method or multiple cooling units with the same cooling method may not be installed due to a space requirement.

More specifically, when a cooling device employs a heat pipe roller, the heat pipe roller includes a roller and a radiation fin, and the diameter of the radiation fin is greater than the diameter of the roller. Due to this configuration, in a case in which multiple heat pipe rollers are aligned, the radiation fin of one heat pipe roller of the multiple heat pipe rollers interferes movement of the radiation fin of another heat pipe roller disposed adjacent to the one heat pipe roller. Even when respective positions of the multiple heat pipe rollers are shifted to have wider space therebetween in order to prevent the multiple heat pipe rollers from interfering with each other, the cooling device increases in size in a sheet conveying direction. In addition, a gap between two adjacent heat pipe rollers increases, resulting in deterioration of the cooling performance to a recording medium to be conveyed.

By contrast, when a cooling device employs a heat sink, the heat sink includes a fin extending in a vertical direction that interferes with a sheet conveying direction in which a recording medium is conveyed. Accordingly, when a heat sink is provided above and below the recording medium in the sheet conveying direction, the cooling device is extended in a vertical direction, and therefore the size of the cooling device increases.

Further, the cooling units having the same cooling method include respective heat absorbing surfaces having the same shape. Therefore, the cooling units have a sheet entry direction of the recording medium toward the cooling device and a sheet discharging direction of the recording medium from the cooling device, which is the same direction as the sheet entry direction.

Accordingly, a guiding member is provided to guide the recording medium after passing the cooling device toward a sheet discharging unit that is disposed at a position different from a sheet ejecting direction.

In addition, the cooling device may need to provide a belt disposed facing the recording medium to hold and convey the recording medium, and further respective belt drive units for the cooling units disposed at the upstream side and the downstream side in the sheet conveying direction.

Accordingly, a large section in which the recording medium is not cooled is provided between a cooling unit disposed at the upstream side and another cooling unit disposed at the downstream side. As a result, the image forming apparatus increase in size, and therefore the cooling efficiency deteriorates.

SUMMARY

At least one aspect of this disclosure provides a cooling device including a first cooler configured to cool a first face of a recording medium and a second cooler configured to cool a second face of the recording medium. The first cooler includes a first heat absorbing face and a first liquid flowing passage. The first heat absorbing face is configured to contact an inner circumferential surface of a belt to face the first face of the recording medium. The second cooler includes a second heat absorbing face and a second liquid flowing passage. The second heat absorbing face is disposed facing the second face of the recording medium.

Further, at least one aspect of this disclosure provides an image forming apparatus including a heating device configured to fix a toner image to the recording medium, and the above-described cooling device configured to cool the recording medium conveyed from the heating device.

DETAILED DESCRIPTION

Figure 1:
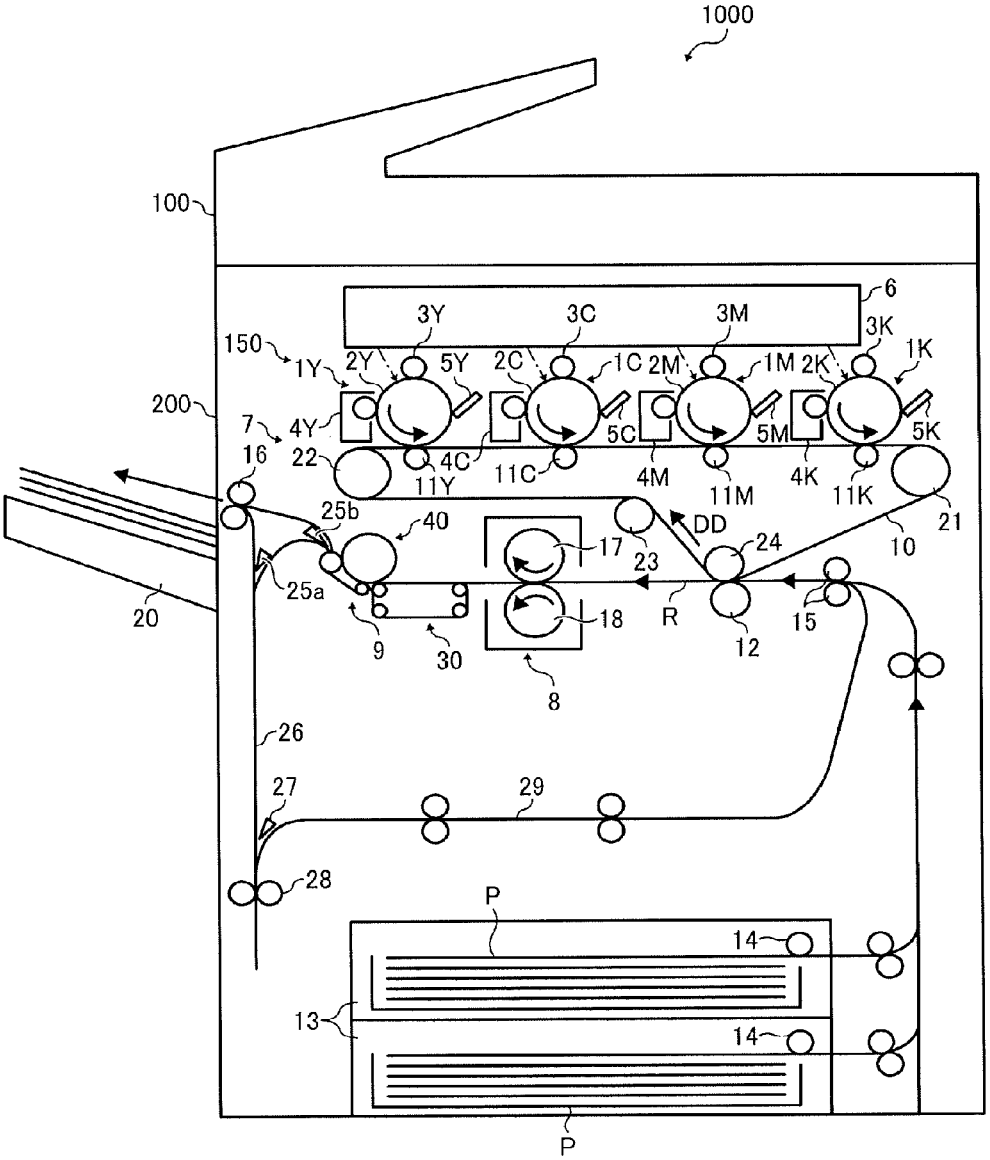
FIG. 1 is a schematic view illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of a color image forming apparatus 1000 according to an embodiment of this disclosure with reference to the drawings.

It is to be noted that identical parts are given identical reference numerals and redundant descriptions are summarized or omitted accordingly.

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a schematic diagram illustrating a color image forming apparatus 1000 according to an embodiment of this disclosure.

As illustrated in FIG. 1, the image forming apparatus 1000 has a housing 200 that includes a tandem-type image forming part 150, an exposure device 6, a transfer device 7, and four primary transfer rollers 11Y, 11C, 11M, and 11K.

The tandem-type image forming part 150 includes four process units 1Y, 1C, 1M, and 1K functioning as image forming units aligned in tandem. Suffixes, which are Y, C, M, and K, are used to indicate respective colors of toners (e.g., yellow, cyan, magenta, and black toners) for the process units. The process units 1Y, 1C, 1M, and 1K have substantially the same configuration except for containing different color toners of yellow (Y), cyan (C), magenta (M), and black (K) corresponding to color separation components of a color image. The process units 1Y, 1C, 1M, and 1K are detachably attachable to the housing 200 of the image forming apparatus 1000.

The four process units 1Y, 1C, 1M, and 1K form respective single color toner images of yellow (Y), cyan (C), magenta (M), and black (K) on photoconductors 2Y, 2C, 2M, and 2K, respectively. The exposure device 6 is disposed above the process units 1Y, 1C, 1M, and 1K and exposes respective surfaces of the photoconductors 2Y, 2C, 2M, and 2K, respectively, to form respective electrostatic latent images thereon.

It is to be noted that FIG. 1 illustrates the four process units 1Y, 1C, 1M, and 1K having the identical configuration and functions to each other except toner colors, which are yellow (Y), magenta (M), cyan (C), and black (K). Each process unit 1 includes the photoconductor 2 (i.e., photoconductors 2Y, 2C, 2M, and 2K) and an image forming components disposed around the photoconductor 2 in a counterclockwise direction in the drawing. Specifically, the image forming components are a charging roller 3 (i.e., charging rollers 3Y, 3C, 3M, and 3K) that is disposed substantially upward from a rotation center of the photoconductor 2, a developing device 4 (i.e., developing devices 4Y, 4C, 4M, and 4K), and a photoconductor cleaning blade 5 (i.e., photoconductor cleaning blades 5Y, 5C, 5M, and 5K).

Specifically, the photoconductor 2 has a drum shape and functions as a latent image bearer. The charging roller 3 serves as a charger to charge a surface of the photoconductor 2. The developing device 4 forms a toner image on the surface of the photoconductor 2. The photoconductor cleaning blade 5 serves as a cleaner to clean the surface of the photoconductor 2.

In FIG. 1, the exposure device 6 is disposed above the respective surfaces of the process units 1Y, 1C, 1M, and 1K. The exposing device 6 includes, e.g., a light source, polygon mirrors, f-θ lenses, and reflection lenses to irradiate a laser beam onto the surface of the photoconductor 2.

The transfer device 7 is disposed below the process units 1Y, 1C, 1M, and 1K. The transfer device 7 includes an intermediate transfer belt 10 including an endless belt that functions as a transfer body. The intermediate transfer belt 10 is stretched over multiple of rollers 21 through 24 functioning as supports. One of the rollers 21 through 24 is rotated as a driving roller to circulate (rotate) the intermediate transfer belt 10 in a direction indicated by arrow DD in FIG. 1.

Four primary transfer rollers 11Y, 11C, 11M, and 11K functioning as primary transfer units are disposed at positions at which the primary transfer rollers 11Y, 11C, 11M, and 11K face the respective photoconductors 2Y, 2C, 2M, and 2K. At the respective positions, the primary transfer rollers 11Y, 11C, 11M, and 11K are pressed against an inner circumferential surface of the intermediate transfer belt 10. Thus, primary transfer nip regions are formed at positions at which the photoconductors 2Y, 2C, 2M, and 2K contact pressed portions of the intermediate transfer belt 10. Each of the primary transfer rollers 11Y, 11C, 11M, and 11K is connected to a power source, and a given direct current (DC) voltage and/or an alternating current (AC) voltage are supplied to the primary transfer rollers 11Y, 11C, 11M, and 11K.

A secondary transfer roller 12 that functions as a second transfer unit is disposed at a position at which the secondary transfer roller 12 faces the roller 24 that is one of the rollers over which the intermediate transfer belt 10 is stretched. The secondary transfer roller 12 is pressed against an outer circumferential surface of the intermediate transfer belt 10. Thus, a secondary transfer nip region is formed at a position at which the secondary transfer roller 12 and the intermediate transfer belt 10 contact each other. Similar to the primary transfer rollers 11Y, 11C, 11M, and 11K, the secondary transfer roller 12 is connected to a power source, and a given direct current (DC) voltage and/or an alternating current (AC) voltage are supplied to the secondary transfer roller 12.

Multiple sheet trays 13 are disposed below the housing 200 to accommodate sheet-type recording medium P, such as sheets of paper or overhead projector (OHP) sheets. Multiple sheet trays 13 are disposed below the housing 200 to accommodate sheet-type recording medium P, such as sheets of paper or overhead projector (OHP) sheets. Each sheet tray 13 is provided with a feed roller 14 to feed the recording media P stored therein. An output tray 20 that functions as a sheet output unit is mounted on an outer circumferential surface of the housing 200 at the left side in FIG. 1 to stack recording medium P discharged to an outside of the housing 200.

The housing 200 includes a recording medium conveying passage R to transport a recording medium P from the sheet trays 13 to the output tray 20 through the secondary transfer nip region. On the recording medium conveying passage R, registration rollers 15 are disposed upstream from the secondary transfer roller 12 in a conveying direction of a recording medium (hereinafter, referred to as a "sheet conveying direction"). A fixing device 8, a recording medium cooling device 9, and a pair of output rollers 16 are disposed in turn at positions downstream from the secondary transfer roller 12 in the sheet conveying direction. The fixing device 8 that functions as a heating device includes a fixing roller 17 and a pressure roller 18. The fixing roller 17 functions as a fixing member including an internal heater (a heat source). The pressure roller 18 that functions as a pressing member to press the fixing roller 17. A fixing nip region is formed at a position at which the fixing roller 17 and the pressing roller 18 contact each other. It is to be noted that the configuration of the fixing device 8 is not limited to a roller-type fixing device as described above. For example, a belt-type fixing device can be applied to this disclosure.

Next, a description is given of a basic operation of the image forming apparatus 1000 with reference to FIG. 1.

It is to be noted that the components and units having the identical configuration or structure except for toner color are occasionally described without suffixes. For example, the photoconductors 2Y, 2C, 2M, and 2K are hereinafter also referred to in a singular form as the photoconductor 2.

When imaging operation is started, the photoconductor 2 (i.e., the photoconductors 2Y, 2C, 2M, and 2K) of the process unit 1 (i.e., the process units 1Y, 1C, 1M, and 1K) is rotated counterclockwise in FIG. 1, and the charging roller 3 (i.e., the charging rollers 3Y, 3C, 3M, and 3K) uniformly charges the surface of the photoconductor 2 with a given polarity. Based on image information of a document read by a reading device 100 or print information instructed by an external device, the exposing device 6 irradiates laser light onto the charged surface of the photoconductor 2 to form an electrostatic latent image on the surface of the photoconductor 2. At this time, image information exposed to each photoconductor 2 is single-color image information obtained by separating a desired full-color image into single-color information on yellow, cyan, magenta, and black. The developing device 4 (i.e., the developing devices 4Y, 4C, 4M, and 4K) supplies toner onto the electrostatic latent image formed on the photoconductor 2, thus making the electrostatic latent images a visible image as a toner image.

One of the rollers 21 through 24 over which the intermediate transfer belt 10 is stretched is driven to rotate the rollers 21 through 24 to circulate the intermediate transfer belt in the direction indicated by arrow DD in FIG. 1. A voltage having a polarity opposite a charged polarity of toner and subjected to constant voltage or current control is supplied to the primary transfer roller 11 (i.e., the primary transfer roller 11Y, 11C, 11M, and 11K). As a result, a transfer electric field is formed at the primary transfer nip region between each primary transfer roller 11 and the opposing photoconductor 2. Toner images of respective colors on the photoconductors 2 are transferred one on another onto the intermediate transfer belt 10 by the transfer electric fields formed at the primary transfer nip regions. Thus, the intermediate transfer belt 10 bears a full-color toner image on the surface of the intermediate transfer belt 10. Residual toner remaining on each photoconductor 2 without being transferred onto the intermediate transfer belt 10 is removed with the cleaning blade 5.

With rotation of the feed roller 14, a recording medium P is fed from the corresponding sheet tray 13. The recording medium P passes through the registration rollers to be sent to the secondary transfer nip region between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip region. By the transfer electric field formed at the secondary transfer nip region, the toner image on the intermediate transfer belt 10 is collectively transferred onto the recording medium P. Then, the recording medium P is sent into the fixing device 8, and the fixing roller 17 and the pressing roller 18 apply heat and pressure to fix the toner image on the recording medium P. After the recording medium P is cooled with the recording medium cooling device 9, the pair of output rollers 16 output the recording medium P onto the output tray 20.

When performing a duplex printing job, the cooled recording medium P is guided to a reversing path 26 by switching separation pawls 25*a* and 25*b*. Then, a separation pawl 27 is switched and a roller 28 is rotated in a reverse direction, so that the reversed recording medium P is conveyed to the registration rollers 15 via a reversing path 29. Thus, the recording medium P is reversed.

At this time, a toner image that is an image to be printed on a back face of the recording medium P is formed on the intermediate transfer belt 10. After being transferred onto the back face of the recording medium P, this toner image is fixed to the recording medium P by the fixing device 8 and the recording medium P is cooled by the cooling device 9. Then, the recording medium P is conveyed by the pair of output rollers 16 onto the output tray 20.

The above description relates to image forming operation for forming a full color image on a recording medium. In other image forming operation, a single color image can be formed by any one of the process units 1Y, 1C, 1M, and 1K, or a composite color image of two or three colors can be formed by two or three of the process units 1Y, 1C, 1M, and 1K.

Next, a description is given of a configuration of the cooling device 9 according to an embodiment of this disclosure.

Figure 2A:
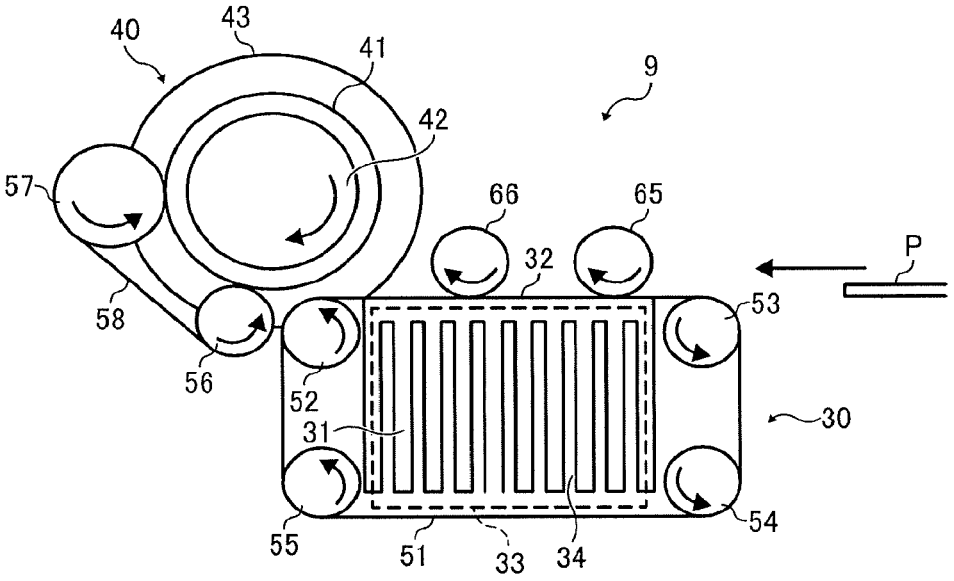
FIG. 2A is a side view illustrating a cooling device included in the image forming apparatus of FIG. 1, viewed from a front of the image forming apparatus.
Figure 2B:
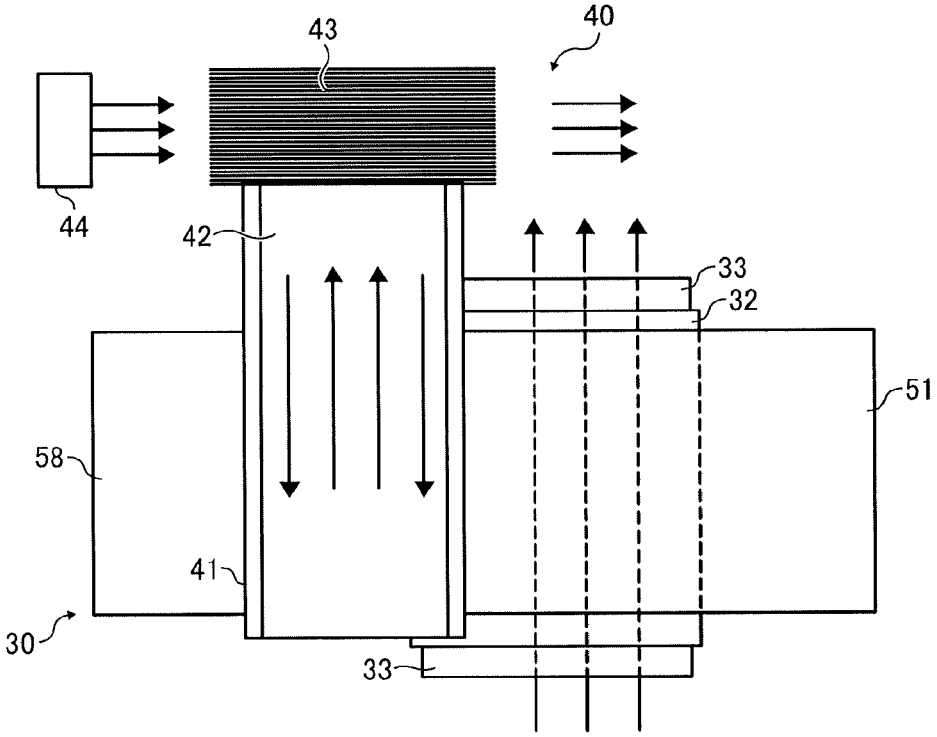
FIG. 2B is a plan view illustrating the cooling device of FIG. 2A, viewed from a top of the image forming apparatus.

FIG. 2A is a side view illustrating the cooling device 9 included in the image forming apparatus 1000 of FIG. 1, viewed from a front of the image forming apparatus 1000. FIG. 2B is a plan view illustrating the cooling device 9 of FIG. 2A, viewed from a top of the image forming apparatus 1000.

The cooling device 9 includes a first cooler 30 and a second cooler 40. The first cooler 30 cools a back face side of the recording medium P (i.e., a non-image forming face or a face on which no image is formed in a single-side printing job) and the second cooler 40 cools a front face side of the recording medium P (i.e., an image forming face or a face on which an image is formed in the single-side printing job). Specifically, the first cooler 30 includes a first heat absorbing face 32 that contacts the recording medium P via a first conveying belt 51 that functions as a first belt. The second cooler 40 includes a second heat absorbing face 41 that directly contacts the recording medium P and has a cooling structure different from the cooling structure of the first cooler 30. In addition, both the first cooler 30 and the second cooler 40 include a liquid flowing passage.

The above-described configuration can use the merits in the layout of the first cooler 30 and the second cooler 40, and therefore can achieve a space-saving and efficient layout of the cooling device 9. In addition, the configuration can achieve a reduction in size of the cooling device 9 and the image forming apparatus 1000.

Specifically, the first cooler 30 that is a heat sink includes the first heat absorbing face 32 having a flat heat absorbing surface having a width extending in the sheet conveying direction in which a recording medium is conveyed. The first heat absorbing face 32 is disposed upstream from the second cooler 40 in the sheet conveying direction. The first cooler 30 (for example, a heat sink) includes fins 31 and fan 33. The fins 31 function as multiple heat dissipating bodies extending from the first heat absorbing face 32 in a direction separating from a recording media conveying passage and perpendicular to the sheet conveying direction. The fan 33 functions as an airflow generator to generate airflow that passes through the liquid flowing passage 34 between the fins 31. The first heat absorbing face 32 and the fins 31 include metal material. Heat received by the first heat absorbing face 32 is dissipated via the fins 31.

As illustrated in FIG. 2B, the fins 31 are disposed immediately below the first conveying belt 51. That is, the fins 31 are disposed facing the width of the first conveying belt 51 perpendicular to the sheet conveying direction.

The fans 33 are disposed at the front side of the first cooler 30, e.g., a heat sink (the front side of the image forming apparatus 1000) and the back side of the first cooler 30 (the back side of the image forming apparatus 1000). As illustrated in FIG. 2B, the fan 33 at the front side blows, that is, exhausts air toward the fins 31. The fan 33 at the back side intakes air inside the fins 31 and exhausts the air out the image forming apparatus 1000. Alternatively, the fan 33 at the front side can be disposed at the front side of the first cooler 30 (the heat sink) while no fan 33 is disposed at the back side. It is to be noted that air flow can flow in an opposite direction to the above-described air flow.

In FIG. 2A, the fins 31 form the liquid flowing passage 34 through which air flow passes in the vertical direction in the drawing sheet. The liquid flowing passage 34 in the first cooler 30 is formed in a direction intersecting the sheet conveying direction.

The recording medium P passes through the fixing device 8 that is disposed upstream from the cooling device 9 in the sheet conveying direction. Then, as illustrated in FIG. 2A, the recording medium P travels in a sheet conveying passage formed between sheet conveying rollers 65 and 66 and the first heat absorbing face 32 of the first cooler 30 in the cooling device 9. By so doing, the heat of the recording medium P is taken by the first heat absorbing face 32. Consequently, the heat of the first heat absorbing face 32 is dissipated via the fins 31 and exhausted by the fan 33. It is to be noted that the sheet conveying rollers 65 and 66 are not depicted in FIG. 2B.

The first cooler 30 includes the first conveying belt 51 that conveys the recording medium P. The first conveying belt 51 is wound around a drive roller 52 and driven rollers 53, 54, and 55 to form an endless belt having a loop. An inner circumferential surface of the first conveying belt 51 is in contact with the first heat absorbing face 32 of the first cooler 30. The drive roller 52 is driven by a driving motor to rotate in a counterclockwise direction, so as to rotate the first conveying belt 51.

The second cooler 40 includes a rotatable cylindrical heat pipe roller. The second cooler 40 employing a heat pipe roller configuration includes a second heat absorbing face 41 that has a shape to change a sheet conveying direction of the recording medium P after passing the first heat absorbing face 32. The second cooler 40 can wind a recording medium, and therefore can change the sheet conveying direction while cooling the recording medium. A combination of a heat pipe roller and a heat sink can provide high cooling performance. A face of a recording medium having a toner image faces (contacts) the second cooler 40. However, since the second cooler 40 is disposed at a downstream side in the sheet conveying direction, an angle of conveyance of the recording medium can be changed while restraining a mechanical stress to the toner image on the recording medium.

A heat pipe roller (i.e., the second cooler 40) is a pipe-shaped roller having an inner pipe part 42 in which a refrigerant is inserted. The heat pipe roller (i.e., the second cooler 40) includes a second heat absorbing face 41, the inner pipe part 42, and a fin 43. The second heat absorbing face 41 includes a rotary body. The inner pipe part 42 functions as a liquid flowing passage and a container to contain the refrigerant inside the rotary body. The fin 43 functions as a heat dissipating body in which the refrigerant evaporated by heat of the recording medium and stored in the container is liquefied due to thermal exchange.

As illustrated in FIG. 2B, the fin 43 is disposed at one longitudinal end (a far side) of the heat pipe roller (i.e., the second cooler 40), so as to dissipate heat of the refrigerant. As illustrated in FIG. 2B, the fin 43 that functions as a second heat dissipating body is disposed outside the first conveying belt 51, and therefore the fin 43 is located at a different position from the fin 31 that functions as a first heat dissipating body. While contacting a front face side of the recording medium P during conveyance of the recording medium P (an image forming face when performing a single-side printing job), an outer circumference of the heat pipe roller (i.e., the second cooler 40) is rotated with movement of a second conveying belt 58 in a clockwise direction.

The outer circumference of the heat pipe roller (i.e., the second cooler 40) includes a second heat absorbing face 41 that contacts the recording medium P, so that heat of the recording medium P is taken by the second heat absorbing face 41. The second heat absorbing face 41 has a circular cross section, which is different from the shape of the first heat absorbing face 32. The liquid refrigerant of the inner pipe part 42 that has received the heat from the recording medium P vaporizes on the second heat absorbing face 41. The vaporized heat (steam) moves through a center passage of the inner pipe part 42 (i.e., a fluid passage) toward the far side of the cooling device 9 where the fin 43 is disposed, as illustrated in FIG. 2B. The (vaporized) refrigerant contacts an inner wall of the fin 43 that is cooled by airflow blowing from the fan 44. Due to the contact of the refrigerant with the cooled inner wall of the fin 43, heat exchange occurs to condense the refrigerant into a liquid form, as illustrated in FIG. 2B. Consequently, the refrigerant passes through the center passage of the inner pipe part 42 back to the heat receiving part at the near side of the cooling device 9, where the refrigerant is vaporized again due the heat exchange. The above-described cycle is repeated.

In FIG. 2A, the inner pipe part 42 includes and functions as a fluid passage through which fluid (e.g., liquid refrigerant, vaporized gas) passes in a vertical direction to the drawing sheet. By contrast, in FIG. 2B, the fluid passage extends in a direction intersecting the sheet conveying direction.

The second cooler 40 includes the second conveying belt 58 that functions as a second belt and conveys the recording medium P. The second conveying belt 58 includes an inner circumferential surface and is wound around the drive roller 57 and the driven roller 56 in contact with the inner circumferential surface to form an endless belt having a loop. The second conveying belt 58 also includes an outer circumferential surface disposed facing the second heat absorbing face 41 of the heat pipe roller (i.e., the second cooler 40). The outer circumferential surface of the second conveying belt 58 is biased by the heat pipe roller. Accordingly, the second conveying belt 58 is inwardly curved along with the outer circumferential surface of the heat pipe roller (i.e., the second cooler 40). The drive roller 52 is driven by a driving motor to rotate in the counterclockwise direction, so as to rotate the second conveying belt 58 in the counterclockwise direction.

The first conveying belt 51 and the second conveying belt 58 use different drive sources, and therefore the first conveying belt 51 of the first cooler 30 and the second conveying belt 58 of the second cooler 40 are controlled separately. By having different drive sources, the load to the first conveying belt 51 and the load to the second conveying belt 58 can be reduced.

The first cooler 30 and the second cooler 40 are not disposed facing each other in a direction intersecting each other but are shifted from each other in the sheet conveying direction. Since the heat absorbing surface of the first cooler 30 and the heat absorbing surface of the second cooler 40 have different shapes from each other, when the first cooler 30 and the second cooler 40 are disposed facing each other, it is difficult to secure a good contact area with respect to the recording medium P. Therefore, by disposing multiple coolers shifted from each other in the sheet conveying direction, the contact area can be optimized according to the shape of each heat absorbing surface, and therefore the contact area with the recording medium P can be secured sufficiently.

Further, the first cooler 30 is disposed upstream from the fixing device 8 in the sheet conveying direction and the second cooler 40 is disposed downstream from the fixing device 8 in the sheet conveying direction. A starting point of the nip region between the first heat absorbing face 32 and the sheet conveying rollers 65 and 66 is located at a substantially same height as a starting point of a nip region between the second heat absorbing face 41 and the first conveying belt 51. Therefore, the recording medium P can be conveyed smoothly from the first cooler 30 to the second cooler 40. The second cooler 40 winds the recording medium P around the outer circumference, and therefore can change the sheet conveying direction according to a winding angle of the recording medium P (a transport angle) while cooling the recording medium P.

However, when the recording medium P is cooled by the second cooler 40 for the first time, the second cooler 40 applies a load of curvature of the recording medium P and cools the recording medium P after the recording medium P is heated by the fixing device 8. As a result, the second cooler 40 applies a peculiar winding (curl) in a winding direction to the recording medium P.

By contrast, the first cooler 30 has the width extending in the sheet conveying direction and has a smaller load of curvature of the recording medium P. Therefore, by cooling the recording medium P after heated by the fixing device 8, the peculiar winding of the recording medium P is prevented. Accordingly, the recording medium P is guided to the second cooler 40 in a cooled and stable state.

Further, the first cooler 30 is disposed on the opposite side of the recording medium P to which a toner image is fixed in the fixing device 8 and the second cooler 40 is disposed on the opposite side of the first cooler 30 across the recording media conveying passage. According to this positional relation, a space can be secured above the first cooler 30. Therefore, when the recording medium P is jammed between the fixing device 8 and the second cooler 40, good visibility and sheet removing performance can be enhanced when a user removes the jammed sheet from the image forming apparatus 1000.

In the present embodiment, the first cooler 30 (the heat sink) includes the first heat absorbing face 32 having the width extending in the sheet conveying direction. However, the configuration of the first cooler 30 is not limited thereto. For example, a liquid type cooling device that includes the first heat absorbing face 32 having the width extending in the sheet conveying direction and a liquid flowing passage 63 through which the liquid flows (see FIG. 4) can be applied to the first cooler 30 of this disclosure.

Further, the configuration of the second cooler 40 is not limited to the above-described rotatable heat pipe roller. For example, a liquid type rotary cooling device that includes the liquid flowing passage 63 through which a roller is disposed for the liquid to flow for heat transport (see FIG. 5) can be employed to the second cooler 40 of this disclosure.

Figure 3:
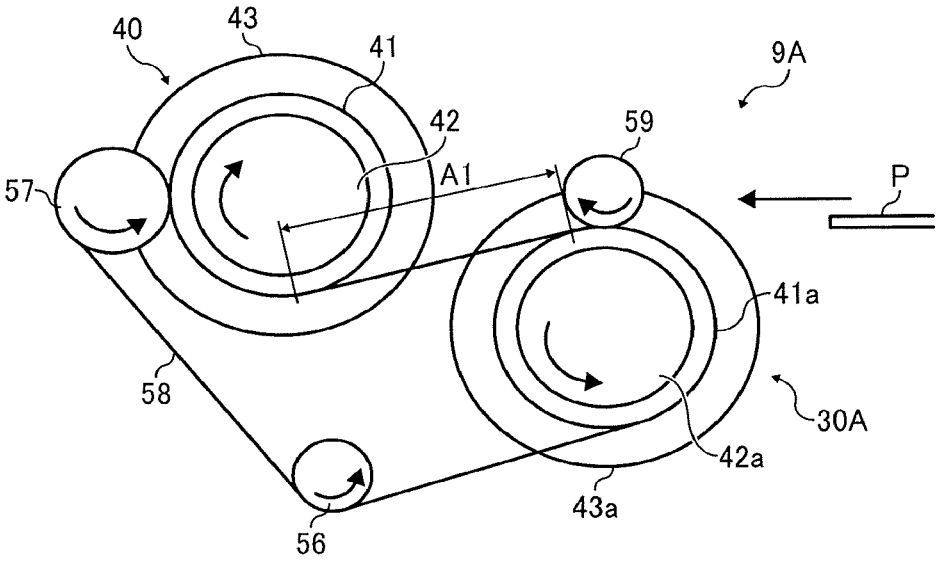
FIG. 3 is a diagram illustrating a comparative cooling device to the cooling device of FIG. 2.

FIG. 3 is a diagram illustrating a comparative cooling device 9A to the cooling device 9 of FIG. 2.

The comparative cooling device 9A illustrated in FIG. 3 includes a first cooler 30A and a second cooler 40A, both include respective heat pipe rollers. The first cooler 30A (i.e., the heat pipe roller) includes a heat absorbing surface 41 and a fin 43*a*, and the second cooler 40A (i.e., the heat pipe roller) includes a heat absorbing surfaces 41*a* and the fin 43. The heat absorbing surfaces 41 and 41*a* have an identical shape to each other. The outer diameter of the fin 43 is greater than the outer diameter of the heat pipe roller (i.e., the second cooler 40) having the heat absorbing surface 41.

Further, the fin 43*a* of the first cooler 30A and the fin 43 of the second cooler 40A are disposed at the far side of the cooling device 9A (the far side on the drawing sheet) from the second conveying belt 58 and adjacent to each other in the sheet conveying direction. As a result, the fin 43 of the second cooler 40A interferes with the fin 43*a* of the first cooler 30. Therefore, the heat absorbing surfaces 41 and 41*a* cannot be disposed facing each other such that a nip region is formed between the heat absorbing surfaces 41 and 41*a* or adjacent to each other at upstream and downstream positions in the sheet conveying direction.

In order to avoid interference of the fins 43 and 47*a* with each other, the heat absorbing surface 41 and the heat absorbing surface 41*a* are disposed shifted from each other in the sheet conveying direction, as illustrated in FIG. 3. However, as the fin 43 and the fin 43*a* are shifted from each other, the cooling device 9A increases in size. Further, shifting the positions of the fin 43 and the fin 43*a* creates a non-contact region A1 where the second conveying belt 58 and the heat absorbing surfaces 41 and 41*a* do not contact with each other between the heat absorbing surface 41 and the heat absorbing surface 41*a*. As a result, the cooling performance deteriorates.

By contrast, the cooling device 9 according to the present embodiment of this disclosure as illustrated in FIGS. 2A and 2B, the first cooler 30 does not have a fin at the far side of the cooling device 9 intersecting the sheet conveying direction. Accordingly, as illustrated in FIG. 2B, the fin 43 of the second cooler 40 does not interfere with the first cooler 30.

Therefore, as illustrated in FIG. 2A, the fin 31 or the first conveying belt 51 of the first cooler 30 can be inserted to an inner circumference area of the fin 43 of the second cooler 40. As a result, when compared with the configuration of the cooling device 9A illustrated in FIG. 3, the configuration of the cooling device 9 according to the present embodiment can restrain an increase in size in the sheet conveying direction. Further, when compared with the configuration of the cooling device 9A, the cooling device 9 according to the present embodiment can make the distance from a left end portion (a downstream end in the sheet conveying direction) of the first heat absorbing face 32 illustrated in FIG. 2A to a starting point of a nip region that corresponds to a contact face between the second heat absorbing face 41 and the first conveying belt 51 (a region of the sheet conveying passage where the recording medium P does not contact a cooling portion). Accordingly, the cooling device 9 of FIGS. 2A and 2B has a higher cooling performance compared to the comparative cooling device 9A of FIG. 3.

There is a case of a comparative cooling device in which the heat sink employed in the first cooler 30 illustrated in FIG. 2A is also applied to the second cooler 40. In this case, since the fin extends in a direction vertically intersecting the recording media conveying passage (that is, in a vertical direction), the size of the cooling device increases in height.

By contrast, the cooling device 9 of FIG. 2A has a configuration in which the diameter of the heat pipe roller (i.e., the second cooler 40) having the second heat absorbing face 41 is smaller than the height of the fin 31. By so doing, the cooling device 9 can be lower in height when compared with the configuration of the above-described comparative cooling device having a heat sink in both the first cooler and the second cooler.

Further, a combination of a heat sink having a substantially linear sheet conveying direction and a heat pipe roller having a roller shape can change an ejecting direction of the recording medium P in the cooling device 9 according to the winding angle of the heat pipe roller (i.e., the second cooler 40) with respect to an entering direction of the recording medium P. Accordingly, the layout performance of the image forming apparatus 1000 can be enhanced.

As described above, a reduction in size of the cooling device 9 and the image forming apparatus 1000 can be achieved by including the first cooler 30 and the second cooler having different cooling types or configurations from each other.

It is to be noted that the configuration of the first cooler 30 and the configuration of the second cooler 40 are not limited to FIGS. 2A and 2B. For example, a liquid type cooler can be employed as illustrated in FIG. 4.

Figure 4A:
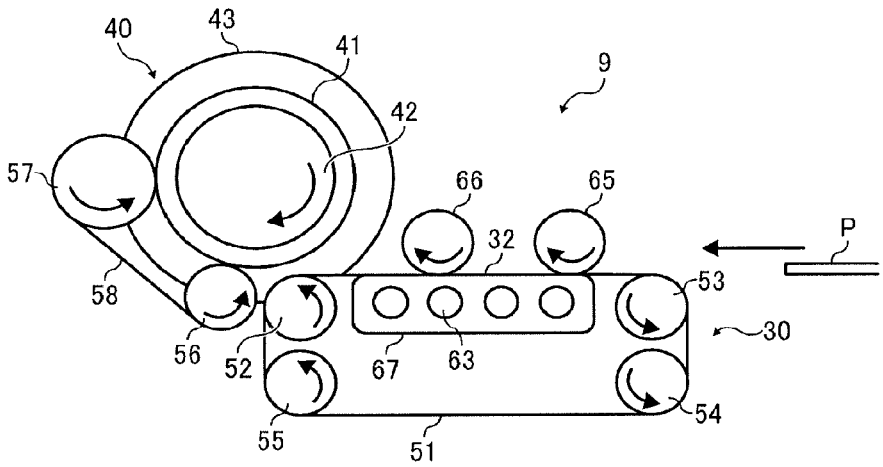
FIG. 4A is a side view illustrating a cooling device provided with a liquid cooling jacket in a first cooler, viewed from the front of the image forming apparatus.
Figure 4B:
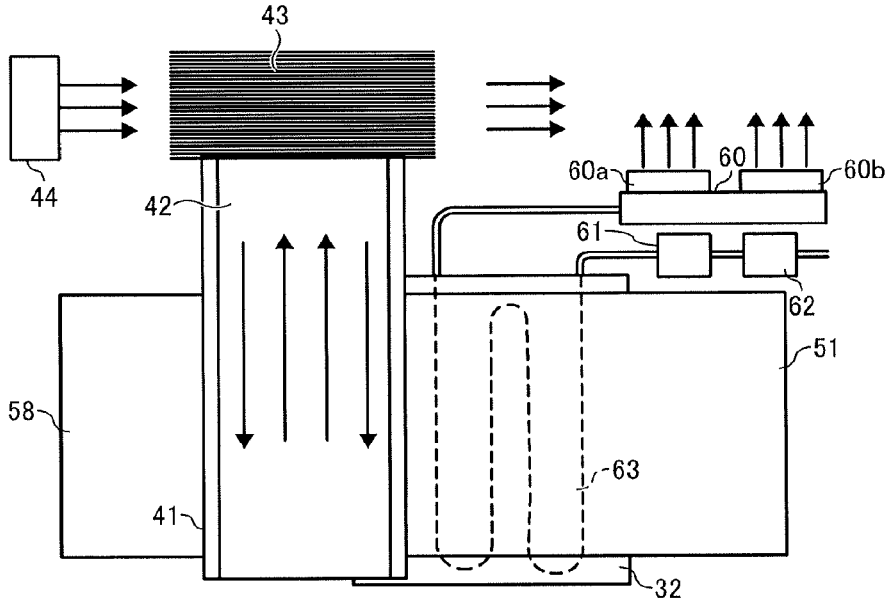
FIG. 4B is a plan view illustrating the cooling device of FIG. 4A, viewed from the top of the image forming apparatus.

FIG. 4A is a side view illustrating the cooling device 9 provided with a liquid cooling jacket 67 in the first cooler 30, viewed from the front of the image forming apparatus 1000. FIG. 4B is a plan view illustrating the cooling device 9 of FIG. 4A, viewed from the top of the image forming apparatus 1000.

FIG. 4A is a side view illustrating the cooling device 9 provided with a liquid cooling jacket 67 in the first cooler 30, viewed from the front of the image forming apparatus 1000. FIG. 4B is a plan view illustrating the cooling device 9 of FIG. 4A, viewed from the top of the image forming apparatus 1000. As cooled fluid (liquid) flows in the liquid flowing passage 63 inside the liquid cooling jacket 67, the first heat absorbing face 32 is cooled to cool the recording medium P after a toner image is fixed to the recording medium P. By contrast, the heat pipe roller (i.e., the second cooler 40) of FIG. 4A has the same configuration as the second cooler 40 illustrated in FIG. 2A. Thus, a combination of a heat pipe roller and a liquid cooling jacket can provide high cooling performance.

As illustrated in FIG. 4B, the liquid heated by heat of the recording medium P received from the first heat absorbing face 32 passes through a tank 61 to store liquid and a pump 62 to circulate cooling liquid. Thereafter, the liquid is cooled in a radiator 60 that functions as a heat dissipating part. The radiator 60 includes fans 60*a* and 60*b*. Airflow blown from the fans 60*a* and 60*b* passes inside the radiator 60. Then, the liquid flows in the liquid flowing passage 63 inside the liquid cooling jacket 67.

The liquid (cooling liquid) is, for example, a liquid that contains water as main component and an antifreeze (e.g., propylene glycol or ethylene glycol) to reduce the freezing point, and an antirust (e.g., phosphate medium Phosphoric acid potassium salt, or inorganic potassium salt) as additives.

It is to be noted that the air flow direction of the fans 60*a* and 60*b* intersects a direction in which the fan 44 blows air.

The cooling device 9 includes the first cooler 30 and the second cooler 40. The first cooler 30 cools the back face side of the recording medium P (i.e., the non-image forming face in the single-side printing job) and the second cooler 40 cools the front face side of the recording medium P (i.e., the image forming face in the single-side printing job). Specifically, the first cooler 30 includes the first heat absorbing face 32 that contacts the recording medium P via the first conveying belt 51 that functions as a first belt. The second cooler 40 includes the second heat absorbing face 41 that directly contacts the recording medium P and has a cooling structure different from the cooling structure of the first cooler 30.

In addition, both the first cooler 30 and the second cooler 40 include a fluid passage through which fluid (liquid) flows.

The fluid passages in the first cooler 30 and the second cooler 40 in the first cooler 30 are formed in the direction intersecting the sheet conveying direction.

Figure 5:
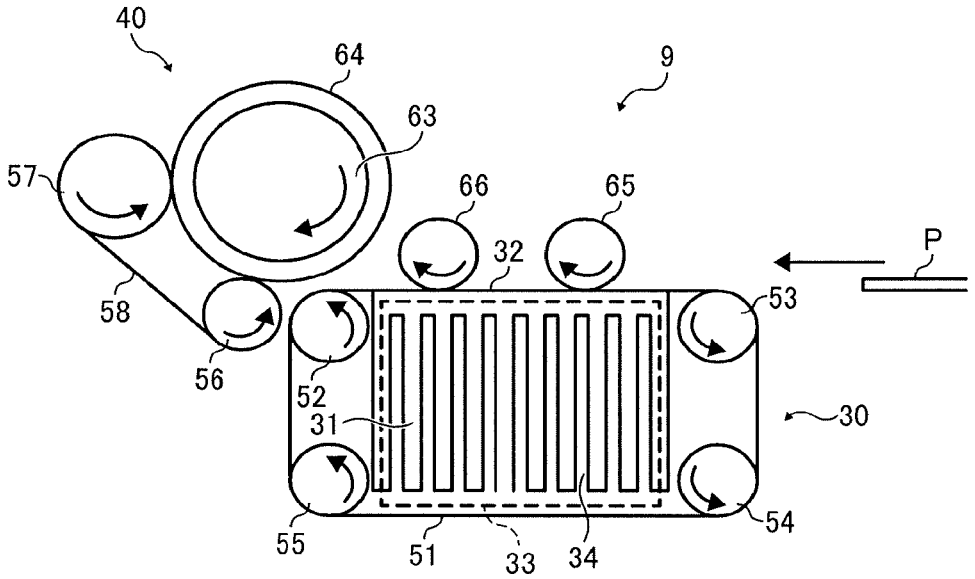
FIG. 5 is a schematic view illustrating a cooling device provided with a liquid cooling roller in a second cooler.

FIG. 5 is a schematic view illustrating the cooling device 9 provided with a liquid cooling roller in the second cooler 40.

As illustrated in FIG. 5, a liquid type rotary cooling device that includes the liquid flowing passage 63 inside the roller can be employed instead of the heat pipe roller (i.e., the second cooler 40) of FIG. 2A. In the case of this cooling device 9 of FIG. 5, respective fluid passages are disposed inside and outside the liquid flowing passage 63. That is, liquid flows in the inside fluid passage and the outside fluid passage. After passing through the roller, the liquid passes through a tank to store liquid and a pump to circulate cooling liquid. Thereafter, the liquid is cooled in a radiator that functions as a heat dissipating part. By employing the above-described liquid type rotary cooling device for the second cooler 40 and combining with the first cooler 30 including a heat sink configuration, a reduction in size of the cooling device 9 and the image forming apparatus 1000 can also be achieved.

The cooling device 9 includes at least the first cooler 30 and the second cooler 40. The first cooler 30 cools the back face side of the recording medium P (i.e., the non-image forming face in the single-side printing job) and the second cooler 40 cools the front face side of the recording medium P (i.e., the image forming face in the single-side printing job). Specifically, the first cooler 30 includes the first heat absorbing face 32 that contacts the recording medium P via the first conveying belt 51 that functions as a first belt. The second cooler 40 includes a second heat absorbing face 64 that directly contacts the recording medium P when conveying the recording medium P and has a cooling structure different from the cooling structure of the first cooler 30.

In addition, both the first cooler 30 and the second cooler 40 include the liquid flowing passage 34 and the liquid flowing passage 63. The liquid flowing passage 34 in the first cooler 30 and the liquid flowing passage 63 in the second cooler 40 are formed in the direction intersecting the sheet conveying direction.

Figure 6:
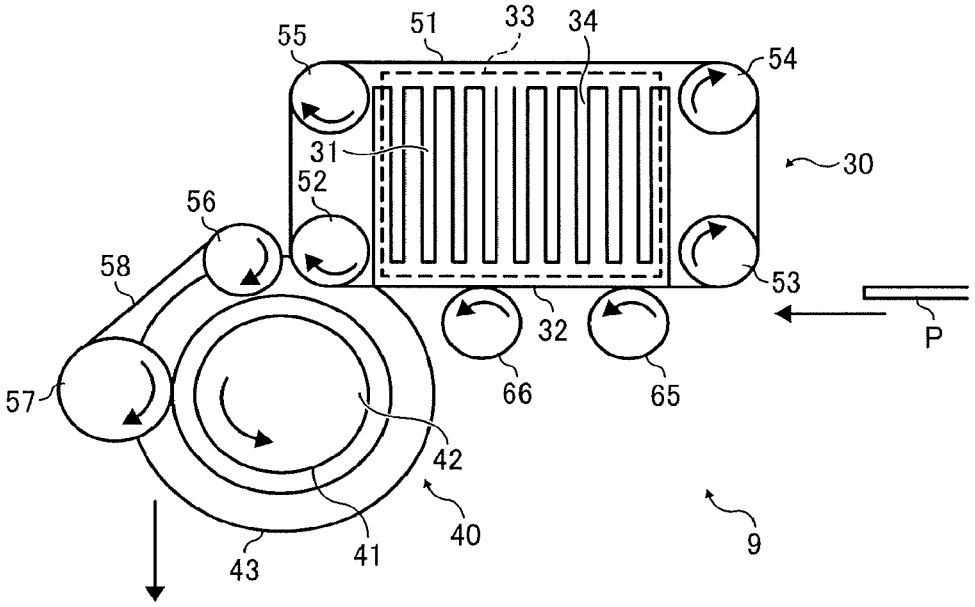
FIG. 6 is a schematic view illustrating a cooling device provided with a first cooler above a recording media conveying passage and a second cooler below the recording media conveying passage.

FIG. 6 is a schematic view illustrating the cooling device 9 provided with the first cooler 30 above the recording media conveying passage and the second cooler 40 below the recording media conveying passage.

In the cooling device 9 of FIG. 6, the first cooler 30 is disposed on the same side as a toner image side of the recording medium P to which a toner image is fixed in the fixing device 8 and the second cooler 40 is disposed on the opposite side of the first cooler 30 across the recording media conveying passage. According to this positional relation, the toner image side of the recording medium P that is ejected from the fixing device 8 is cooled by the first cooler 30 having the width extending in the sheet conveying direction, and then the opposite side of the recording medium P is cooled by the second cooler 40.

The temperature of the first heat absorbing face 32 of the first cooler 30 and the temperature of the second heat absorbing face 41 of the second cooler 40 are constantly maintained to a room temperature. Specifically, the temperature falls within a range of from 20 degree Celsius through 30 degree Celsius. The first heat absorbing face 32 of the first cooler 30 is greater in a contact width to the recording medium P than the second heat absorbing face 41 of the second cooler 40. Therefore, a contact area to the recording medium P can be secured easily. As a result, the cooling device 9 can provide a higher cooling performance. The first heat absorbing face 32 of the first cooler 30 is greater in a contact width to the recording medium P than the second heat absorbing face dispose of the second cooler 40. Therefore, a first cooler 30 to the recording medium P can be secured easily. As a result, the cooling device 9 can provide a higher cooling performance. The first heat absorbing face 32 of the first cooler 30 is disposed near and downstream from the fixing device 8. By so doing, a higher cooling effect can be provided by utilizing a temperature difference between the heated recording medium P and the first cooler 30.

Further, in the cooling device 9 of FIG. 6, the first cooler 30 having a higher cooling effect is disposed on the same side of the toner image side of the recording medium P. By so doing, when passing the recording medium P in the single-side printing job, toner adhering to the recording medium P is cooled and condensed. Accordingly, image failures during conveyance such as abrasion between the toner image surface and a sheet transfer guide before the recording medium P is ejected from the cooling device 9 and uneven gloss due to a sheet conveying roller can be prevented.

The cooling device 9 includes the first cooler 30 and the second cooler 40. The first cooler 30 cools the front face side of the recording medium P (i.e., the image forming face in the single-side printing job) and the second cooler 40 cools the back face side of the recording medium P (i.e., the non-image forming face in the single-side printing job). Specifically, the first cooler 30 includes the first heat absorbing face 32 that contacts the recording medium P via the first conveying belt 51 that functions as a first belt. The second cooler 40 includes the second heat absorbing face 41 that directly contacts the recording medium P and has a cooling structure different from the cooling structure of the first cooler 30. In addition, both the first cooler 30 and the second cooler 40 include the liquid flowing passage 34 and the liquid flowing passage 63. The liquid flowing passage 34 in the first cooler 30 and the liquid flowing passage 63 in the second cooler 40 are formed in the direction intersecting the sheet conveying direction.

Figure 7:
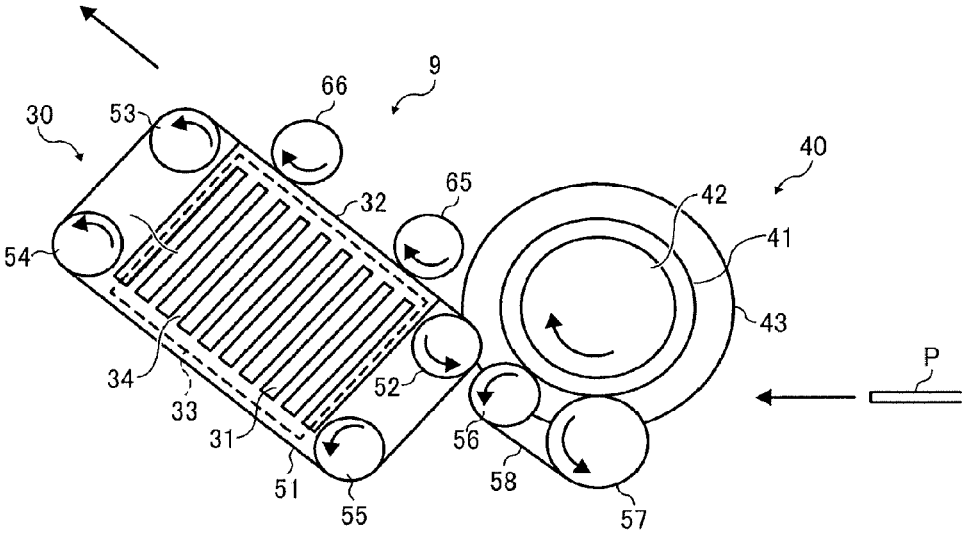
FIG. 7 is a schematic view illustrating a cooling device provided with a first cooler below a downstream side of the recording media conveying passage in the sheet conveying direction and a second cooler above an upstream side of the recording media conveying passage in the sheet conveying direction.

FIG. 7 is a schematic view illustrating the cooling device 9 provided with the first cooler 30 below a downstream side of the recording media conveying passage in the sheet conveying direction and the second cooler 40 above an upstream side of the recording media conveying passage in the sheet conveying direction.

In the cooling device 9 of FIG. 7, the second cooler 40 is disposed opposite to the first cooler 30 across the sheet conveying direction and upstream of the first cooler 30 in the sheet conveying direction. In addition, the second cooler 40 is disposed on the toner image side of the recording medium P to be fixed in the fixing device 8, that is, disposed above the recording media conveying passage.

By contrast, the first cooler 30 is disposed downstream from the second cooler 40 in the sheet conveying direction and opposite to the toner image side of the recording medium P, that is, disposed below the recording media conveying passage.

Generally, an angle of conveyance is changed to a predetermined angle depending on the shape of the sheet transfer guide. However, if the sheet transfer guide is bent or curved, the recording medium P is conveyed while sliding along the shape of the sheet transfer guide, and therefore image failures during conveyance such as damage or scratch onto the image are likely to occur. However, according to the layout of the configuration according to the present embodiment, the cooling device 9 without the sheet transfer guide can cool the recording medium P while the second cooler 40 changes the angle of conveyance of the recording medium P heated by the fixing device 8. Accordingly, the image failures during conveyance due to the movement of the recording medium P sliding along the sheet transfer guide can be prevented.

Further, according to this positional relation, even when the recording medium P is jammed between the second cooler 40 and the pair of output rollers 16 that is disposed at the downstream side of the recording media conveying passage, a space for removing recording media is secured above the first cooler 30. Therefore, good visibility and sheet removing performance can be enhanced when a user removes the jammed sheet from the image forming apparatus 1000.

The cooling device 9 of FIG. 7 includes at least the first cooler 30 and the second cooler 40. The first cooler 30 cools the back face side of the recording medium P (i.e., the non-image forming face in the single-side printing job) and the second cooler 40 cools the front face side of the recording medium P (i.e., the image forming face in the single-side printing job). Specifically, the first cooler 30 includes the first heat absorbing face 32 that contacts the recording medium P via the first conveying belt 51 that functions as a first belt. The second cooler 40 includes the second heat absorbing face 41 that directly contacts the recording medium P and has a cooling structure different from the cooling structure of the first cooler 30.

In addition, both the first cooler 30 and the second cooler 40 include a fluid passage through which fluid (liquid) flows. The fluid passage in the first cooler 30 and the fluid passage in the second cooler 40 are formed in the direction intersecting the sheet conveying direction.

Further, the second heat absorbing face 41 of the heat pipe roller (i.e., the second cooler 40) has a shape to change the sheet conveying direction of the recording medium P toward the first heat absorbing face 32 that is disposed in a direction different from the entering direction of the recording medium P.

Figure 8:
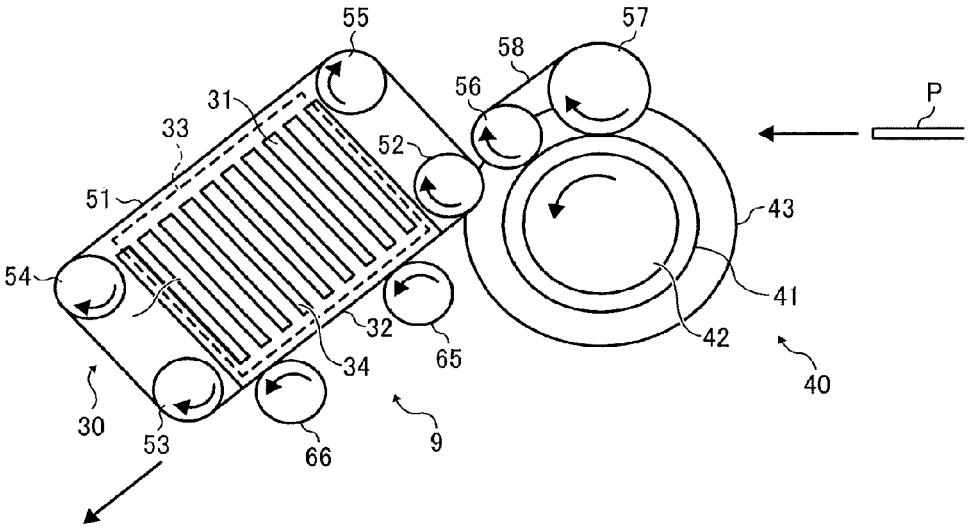
FIG. 8 is a schematic view illustrating a cooling device provided with a first cooler above the downstream side of the recording media conveying passage in the sheet conveying direction and a second cooler below the upstream side of the recording media conveying passage in the sheet conveying direction.

FIG. 8 is a schematic view illustrating the cooling device 9 provided with the first cooler 30 above the downstream side of the recording media conveying passage in the sheet conveying direction and the second cooler 40 below the upstream side of the recording media conveying passage in the sheet conveying direction.

In the cooling device 9 of FIG. 8, the second cooler 40 is disposed upstream from the first cooler 30 in the recording media conveying passage and opposite to the toner image side of the recording medium P to be fixed in the fixing device 8, that is, disposed below the recording media conveying passage.

By contrast, the first cooler 30 is disposed downstream from the second cooler 40 across the recording media conveying passage and on the same side as the toner image side of the recording medium P in the fixing device 8, that is, disposed above the recording media conveying passage.

Generally, an angle of conveyance is changed to a predetermined angle depending on the shape of the sheet transfer guide. However, if the sheet transfer guide is bent or curved, the recording medium P is conveyed while sliding along the shape of the sheet transfer guide, and therefore image failures during conveyance such as damage or scratch onto the image are likely to occur. However, according to the layout of the configuration according to the present embodiment, the cooling device 9 without the sheet transfer guide can cool the recording medium P while the second cooler 40 changes the angle of conveyance of the recording medium P heated by the fixing device 8. Accordingly, the image failures during conveyance due to the movement of the recording medium P sliding along the sheet transfer guide can be prevented.

Further, according to the above-described layout of the configuration according to present embodiment, the first cooler 30 having a large contact area with the recording medium P and a higher cooling effect is disposed on the same side of the toner image side of the recording medium P. By so doing, when passing the recording medium P in the single-side printing job, toner adhering to the recording medium P is cooled and condensed. Accordingly, image failures during conveyance such as abrasion between the toner image surface and the sheet transfer guide before the recording medium P is rejected from the cooling device 9 and uneven gloss due to the sheet conveying roller can be prevented.

The cooling device 9 of FIG. 8 includes at least the first cooler 30 and the second cooler 40. The first cooler 30 cools the back face side of the recording medium P (i.e., the non-image forming face in the single-side printing job) and the second cooler 40 cools the front face side of the recording medium P (i.e., the image forming face in the single-side printing job). Specifically, the first cooler 30 includes the first heat absorbing face 32 that contacts the recording medium P via the first conveying belt 51 that functions as a first belt. The second cooler 40 includes the second heat absorbing face 41 that directly contacts the recording medium P and has a cooling structure different from the cooling structure of the first cooler 30.

In addition, both the first cooler 30 and the second cooler 40 include a fluid passage through which fluid (liquid) flows. The fluid passage in the first cooler 30 and the fluid passage in the second cooler 40 are formed in the direction intersecting the sheet conveying direction.

Further, the second heat absorbing face 41 of the heat pipe roller (i.e., the second cooler 40) has a shape to change the sheet conveying direction of the recording medium P toward the first heat absorbing face 32 that is disposed in a direction different from the entering direction of the recording medium P.

In the cooling device 9 of FIGS. 2 and 4A through 8, the first conveying belt 51 of the first cooler 30 and the second conveying belt 58 of the second cooler 40 are disposed separately. Specifically, the cooling device 9 includes a first belt conveying device that contacts the first cooler 30 while conveying the recording medium P and a second belt conveying device that contacts the second cooler 40 while conveying the recording medium P. The first belt conveying device includes the first conveying belt 51, the drive roller 52, and the driven rollers 53, 54, and 55. The second belt conveying device includes the driven roller 56, the drive roller 57, and the second conveying belt 58. By providing the first belt conveying device to the first cooler 30 and the second belt conveying device to the second cooler 40, both the first conveying belt 51 and the second conveying belt 58 can be driven by different drive sources. Therefore, the load on the drive sources can be reduced. By disposing two small drive sources, an installation space of the image forming apparatus 1000 can be more saved.

Figure 9:
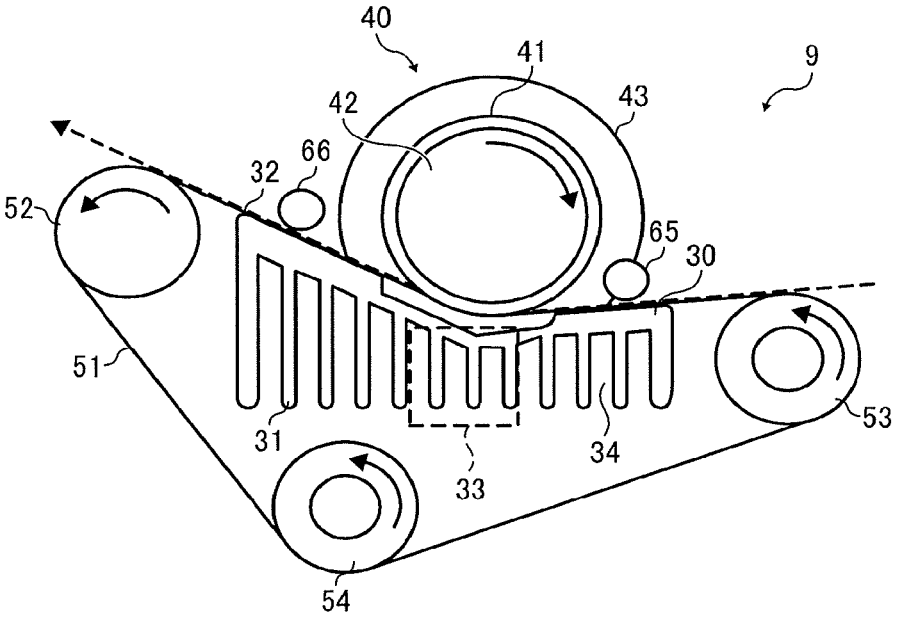
FIG. 9 is a schematic view illustrating a cooling device provided with a first cooler below the recording media conveying passage and a second cooler above the recording media conveying passage.

FIG. 9 is a schematic view illustrating the cooling device 9 provided with the first cooler 30 below the recording media conveying passage and the second cooler 40 above the recording media conveying passage.

In the cooling device 9 of FIG. 9, the first heat absorbing face 32 of the first cooler and the heat absorbing surface 41 of the second cooler 40 are disposed facing each other across the recording media conveying passage. Specifically, the first cooler 30 employing a heat sink and the second cooler 40 employing a heat pipe roller are disposed facing in the vertical direction. The heat sink (i.e., the first cooler 30) is disposed below the heat pipe roller (i.e., the second cooler 40). Further, part of the first cooler 30 (such as the fin 31) is disposed closer toward a shaft center of the fin 43 of the second cooler 40 from the outer circumferential surface of the fin 43 of the second cooler 40. When compared with the configuration in which the first cooler 30 and the second cooler 40 are disposed shifted in the sheet conveying direction as illustrated in FIGS. 2A and 2B, the cooling device 9 of FIG. 9 according to the present embodiment can be reduced in size.

The inner circumferential surface of the first conveying belt 51 is in contact with the first heat absorbing face 32 of the first cooler 30. The inner circumferential surface of the first conveying belt 51 is in contact with the first heat absorbing face 32 of the first cooler 30.

The first heat absorbing face 32 of the first cooler 30 has a shape to change the sheet conveying direction of the recording medium P cooperating together with the second heat absorbing face 41 of the second cooler 40 or a shape to change the sheet conveying direction of the recording medium P in a direction different from the entering direction of the recording medium P. Specifically, the first heat absorbing face 32 of the heat sink (i.e., the first cooler 30) is inclined slightly downward toward the center at the upstream side of the sheet conveying direction. The first heat absorbing face 32 is inclined upward from the center at the downstream side of the sheet conveying direction.

Further, the second heat absorbing face 41 is disposed facing the first heat absorbing face 32. Where the first heat absorbing face 32 faces the second heat absorbing face 41 has a curved shape curved along an outline of the second heat absorbing face 41. The curved shape of the first heat absorbing face 32 contacts the outer circumferential surface of the second heat absorbing face 41. The sheet conveying rollers 65 and 66 are disposed facing the heat sink (i.e., the first cooler 30) with the first conveying belt 51 interposed therebetween. Therefore, the recording medium P is pressed by the sheet conveying roller 65 against the heat sink (i.e., the first cooler 30), so that the recording medium P is cooled. As indicated by a dotted line in FIG. 9, the ejecting direction of the recording medium P is changed such that the recording medium P is ejected in an upwardly inclined direction after the recording medium P has passed the nip region between the first cooler 30 and the second cooler 40 of the cooling device 9. While the second cooler 40 winds a recording medium to change the sheet conveying direction while cooling the recording medium, the first heat absorbing face 32 of the first cooler 30 upstream and downstream from the center and the nip region between the first cooler 30 and the second cooler 40 so as to contact the recording medium. By so doing, a contact range of the first heat absorbing face 32 of the first cooler 30 and the recording medium is increased, thereby achieving a high cooling performance. By bending the first heat absorbing face 32 of the heat sink (i.e., the first cooler 30) into a shape along the recording media conveying passage in the sheet conveying direction, when compared with the configuration in which the first heat absorbing face 32 has a flat shape, the contact area of the first heat absorbing face 32 with the recording medium P increases. Accordingly, a high cooling performance can be achieved.

Further, since the recording medium P is cooled by the sheet conveying roller 65 and the heat sink (i.e., the first cooler 30) before the recording medium P enters into the nip region between the heat pipe roller (i.e., the second cooler 40) and the first conveying belt 51, curling of the recording medium P is restrained, and therefore the recording medium P can enter the nip region easily. Further, after the recording medium P is ejected from the nip region, the load of the recording medium P is received by the heat sink (i.e., the first cooler 30) and the recording medium P is cooled by the sheet conveying roller 66 and the heat sink (i.e., the first cooler 30). Therefore, curling of the recording medium P is restrained and the recording medium P is conveyed toward the pair of output rollers 16 disposed downstream in the sheet conveying direction. Further, by disposing the heat sink (i.e., the first cooler 30) below the heat pipe roller (i.e., the second cooler 40), the load of the recording medium P is received by the first heat absorbing face 32 of the heat sink (i.e., the first cooler 30). Accordingly, the recording medium can closely contact with the first heat absorbing face 32 of the heat sink (i.e., the first cooler 30) without sagging, and therefore the cooling performance can be enhanced.

In FIG. 9, the fan 33 that is disposed at the near side of the image forming apparatus 1000 and before the heat sink (i.e., the first cooler 30) blows and generates airflow. The airflow flows in the liquid flowing passage 34 between the fins 31 of the heat sink (i.e., the first cooler 30) from the near side to the far side. The airflow is sucked by another fan disposed on the back side face of the heat sink (i.e., the first cooler 30).

The cooling device 9 of FIG. 9 includes at least the first cooler 30 and the second cooler 40. The first cooler 30 cools the back face side of the recording medium P (i.e., the non-image forming face in the single-side printing job) and the second cooler 40 cools the front face side of the recording medium P (i.e., the image forming face in the single-side printing job). Specifically, the first cooler 30 includes the first heat absorbing face 32 that contacts the recording medium P via the first conveying belt 51 that functions as a first belt. The second cooler 40 includes the second heat absorbing face 41 that directly contacts the recording medium P and has a cooling structure different from the cooling structure of the first cooler 30.

In addition, both the first cooler 30 and the second cooler 40 include the liquid flowing passage 34 and the fluid passage 42, respectively. The liquid flowing passage 34 in the first cooler 30 and the fluid passage 42 in the second cooler 40 are formed in the direction intersecting the sheet conveying direction.

Further, the first conveying belt 51 functions as a common conveying belt having an inner circumferential surface that slides on the first heat absorbing face 32 and an outer circumferential surface that holds and conveys the recording medium together with the second heat absorbing face 41.

Figure 10:
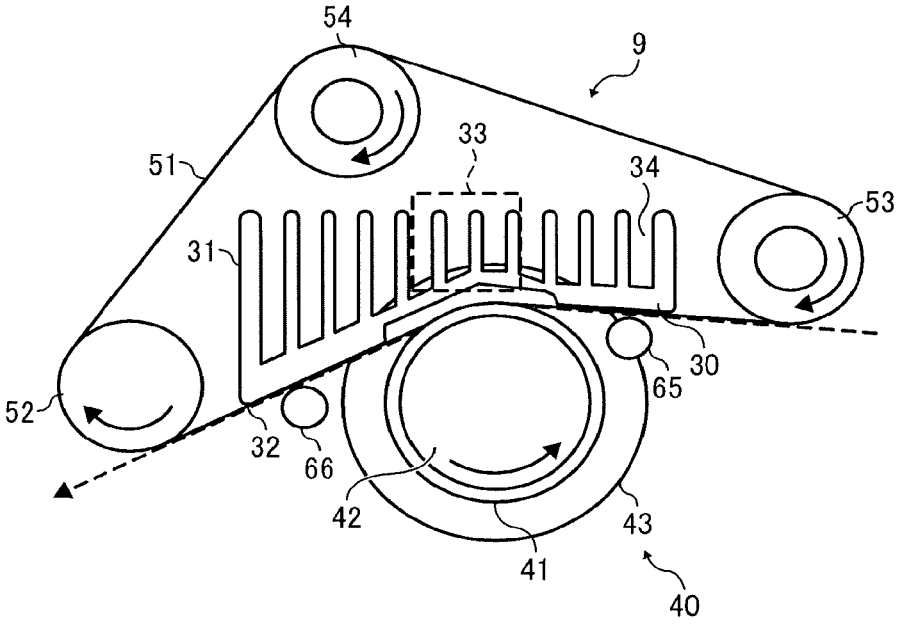
FIG. 10 is a schematic view illustrating a cooling device provided with a first cooler above the recording media conveying passage and a second cooler below the recording media conveying passage.

FIG. 10 is a schematic view illustrating the cooling device 9 provided with the first cooler 30 above the recording media conveying passage and the second cooler 40 below the recording media conveying passage. It is to be noted that parts and components of the cooling device 9 of FIG. 10 are identical to the parts and components of the cooling device 9 of FIG. 9. Therefore, the same reference numerals are used and a detailed description according to this examples is omitted.

When compared with the configuration of the cooling device 9 in which the first cooler 30 and the second cooler 40 are disposed shifted in the sheet conveying direction as illustrated in FIGS. 2A and 2B, the cooling device 9 of FIG. 10 according to the present embodiment can be reduced in size.

The cooling device 9 includes the first cooler 30 and the second cooler 40. The first cooler 30 cools the back face side of the recording medium P (i.e., the non-image forming face in the single-side printing job) and the second cooler 40 cools the front face side of the recording medium P (i.e., the image forming face in the single-side printing job).

The sheet conveying rollers 65 and 66 are disposed facing the first cooler 30 (the heat sink) with the first conveying belt 51 interposed therebetween. Therefore, the recording medium P is pressed by the sheet conveying roller 65 against the first cooler 30 (the heat sink), so that the recording medium P is cooled. As indicated by a dotted line in FIG. 10, the ejecting direction of the recording medium P is changed such that the recording medium P is ejected in a downwardly inclined direction after the recording medium P has passed the nip region between the first cooler 30 and the second cooler 40 of the cooling device 9. By bending the first heat absorbing face 32 of the first cooler 30 (the heat sink) into a shape along the recording media conveying passage in the sheet conveying direction, when compared with the configuration in which the first heat absorbing face 32 has a flat shape, the contact area of the first heat absorbing face 32 with the recording medium P increases. Accordingly, a high cooling performance can be achieved.

Further, since the recording medium P is cooled by the sheet conveying roller 65 and the first cooler 30 (the heat sink) before the recording medium P enters into the nip region between the second cooler 40 (the heat pipe roller) and the first conveying belt 51, curling of the recording medium P is restrained, and therefore the recording medium P can enter the nip region easily. Further, by disposing the first cooler 30 (the heat sink) above the second cooler 40 (the heat pipe roller), the heat moved via the first heat absorbing face 32 of the first cooler 30 (the heat sink) can easily be released from a leading end releasing portion of the fin via the fin of the heat sink (i.e., the first cooler 30) or by passing a space between the fins. Accordingly, when compared with the configuration in which the heat sink (i.e., the first cooler 30) is disposed below the heat pipe roller (i.e., the second cooler 40), the cooling performance can be enhanced.

Figure 11A:
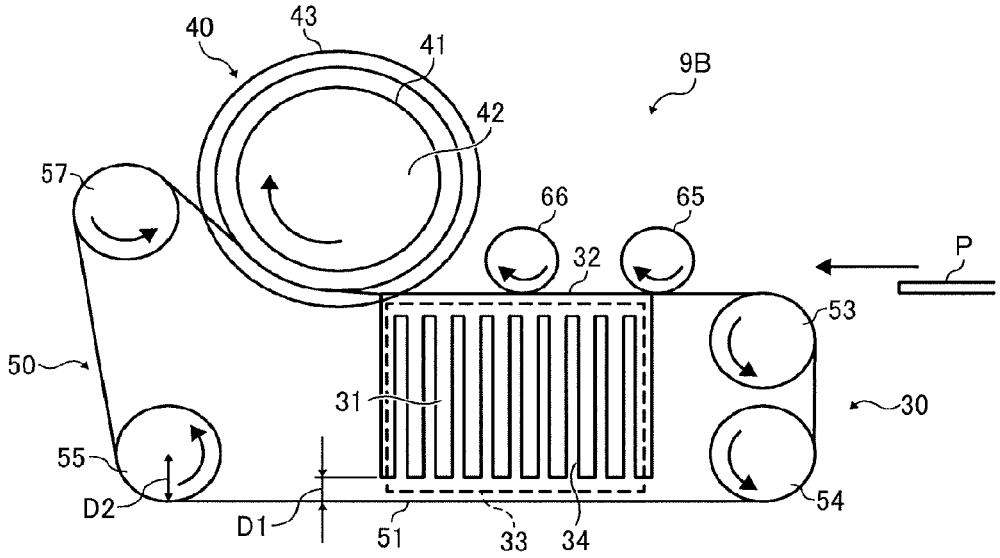
FIG. 11A is a side view illustrating a variation of the cooling device of FIG. 1 and FIG. 2, viewed from the front of the image forming apparatus.
Figure 11B:
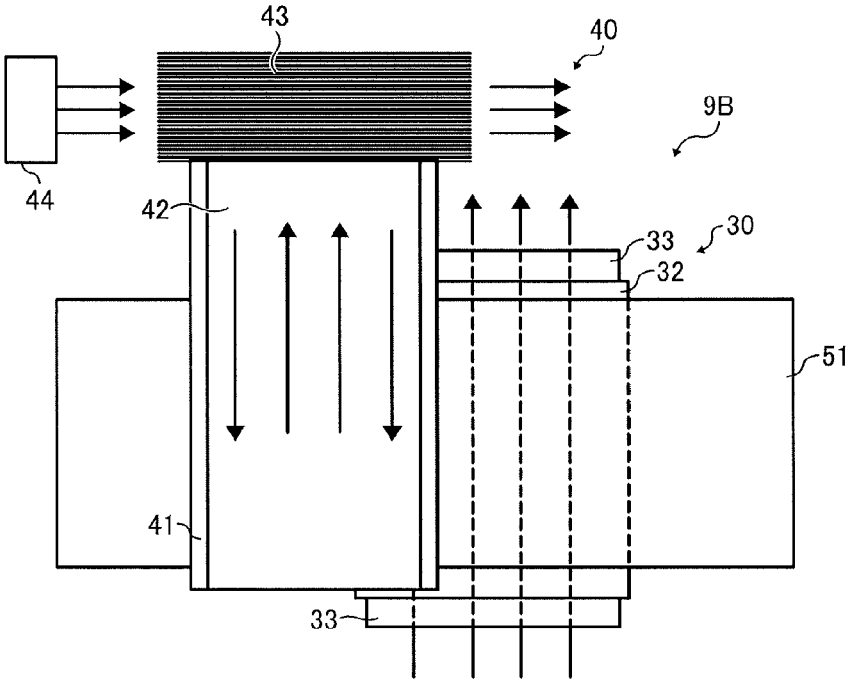
FIG. 11B is a plan view of the cooling device of FIG. 11A, viewed from the top of the image forming apparatus.

FIG. 11A is a side view illustrating a cooling device 9B of a variation of the cooling device 9 of FIG. 1 and FIG. 2, viewed from the front of the image forming apparatus 1000. FIG. 11B is a plan view of the cooling device 9B of FIG. 11A, viewed from the top of the image forming apparatus 1000.

In the cooling device 9 of FIGS. 1, 2, and 4A through 8, the first cooler 30 and the second cooler 40 include separate conveying belt, which are the first conveying belt 51 and the second conveying belt 58, respectively, so as to convey the recording medium P. By contrast, the cooling device 9B in FIGS. 11A and 11B includes a single common conveying belt, which is the first conveying belt 51. Accordingly, in the configuration of FIGS. 11A and 11B, the first conveying belt 51 functions as a common conveying belt.

The cooling device 9B of FIGS. 11A and 11B includes the first cooler 30, the second cooler 40, and a sheet conveying device 50. The first cooler 30 cools the back face side of the recording medium P (i.e., the non-image forming face in the single-side printing job) and the second cooler 40 cools the front face side of the recording medium P (i.e., the image forming face in the single-side printing job). The sheet conveying device 50 conveys the recording medium P.

The first cooler 30 includes a heat sink that includes the first heat absorbing face 32 having a width extending in the sheet conveying direction. The first cooler 30 is disposed upstream from the second cooler 40 in the sheet conveying direction. The configuration of the first cooler 30 other than the above-described structure is identical to the configuration of the first cooler 30 illustrated in FIGS. 2A and 2B.

The second cooler 40 includes a rotatable cylindrical heat pipe roller. A heat pipe roller is a pipe-shaped roller having the inner pipe part 42 in which a refrigerant is inserted.

As illustrated in FIG. 11B, the fin 43 is disposed at one longitudinal end (a far side) of the heat pipe roller (i.e., the second cooler 40), so as to dissipate heat of the refrigerant. While contacting the front face side of the recording medium P during conveyance of the recording medium P (i.e., the image forming face in the single-side printing job), the outer circumference of the heat pipe roller (i.e., the second cooler 40) is rotated with movement of the first conveying belt 51 in the clockwise direction.

The configuration of the second cooler 40 other than the above-described structure is identical to the configuration of the second cooler 40 illustrated in FIGS. 2A and 2B.

The sheet conveying device 50 includes the first conveying belt 51 that forms an endless belt having a loop, the drive roller 52, the driven rollers 53, 54, and 55, and the sheet conveying rollers 65 and 66. The drive roller 52 is driven by the driving motor to rotate in the counterclockwise direction, so as to rotate the first conveying belt 51. The first conveying belt 51 moves from right to left in FIGS. 11A and 11B to convey the recording medium P. The entering direction of the recording medium P to the cooling device 9B is different from the ejecting direction of the recording medium P from the cooling device 9B. In the cooling device 9B, the position of exit from the nip region between the first conveying belt 51 and the second heat absorbing face 41 is set in the direction of the pair of output rollers 16. By so doing, the sheet transfer guide to change the direction of the recording medium P ejected from the cooling device 9B to the pair of output rollers 16 is not used, thereby reducing the number of sheet transfer guides.

As illustrated in FIGS. 11A and 11B, the cooling device 9B includes the first conveying belt 51 and the drive roller 52. The first conveying belt 51 has the inner circumferential surface that slides on the first heat absorbing face 32 and the outer circumferential surface that contacts the second heat absorbing face 41. The drive roller 52 functions as a belt driving body to drive the first conveying belt 51.

Further, the first conveying belt 51 functions as a common conveying belt that contacts both the first heat absorbing face 32 and the second heat absorbing face 41 and that holds and conveys the recording medium P together with the sheet conveying rollers 65 and 66 and the second heat absorbing face 41. This function can also be applied to the configurations of the cooling device 9 of FIGS. 9 and 10. It is to be noted that the shapes of respective heat absorbing surfaces of the first cooler 30 and the second cooler 40 are not limited to the above-described shapes. For example, the first cooler 30 has a roller shape and the second cooler 40 has a shape (for example, a curved shape) different from the roller shape of the first cooler 30.

In addition, the first conveying belt 51 does not contact the fixing device 8.

Accordingly, even when the recording medium P is ejected from the fixing device 8 in the direction as illustrated in FIG. 11A (i.e., left and right directions or a horizontal direction in FIG. 11A), the ejecting direction of the recording medium P from the cooling device 9B can be changed so that the recording medium P is ejected from the cooling device 9B in a different direction, as illustrated in FIG. 11A (i.e., upward and downward directions or a vertical direction in FIG. 11A). Since the upstream and downstream belts and the drive roller 52 can be used in common by the first cooler 30 and the second cooler 40, an increase in size of the image forming apparatus 1000 can be restrained. Therefore, the cooling efficiency is enhanced.

Further, when one of the first cooler 30 and the second cooler 40 includes a cooling method using a heat pipe roller and the other includes a cooling device employing a cooling method different from the cooling method using a heat pipe roller, the first cooler 30 and the second cooler 40 can be disposed closer to each other in the sheet conveying direction, compared to a configuration in which the first cooler 30 and the second cooler 40 employ the heat pipe cooling method. That is, the outer circumferential surface of the fin 43 of the second cooler 40 is located farther toward a shaft center of the second absorbing face 41 than the outer circumferential surface of the second heat absorbing face 41 and part of the first cooler 30 (such as the fin 31) is disposed closer toward a shaft center of the fin 43 of the second cooler 40 from the outer circumferential surface of the fin 43 of the second cooler 40. Accordingly, a non cooling area between the first cooler 30 and the second cooler 40 can be reduced in length in the sheet conveying direction, and therefore the cooling efficiency can be enhanced.

Further, since both the front side face and the back side face of the recording medium P are cooled, a higher cooling effect can be provided.

Further, since the heat sink (i.e., the first cooler 30) can be located closer to the heat pipe roller (i.e., the second cooler 40), the cooling device and the image forming apparatus can be reduced in size.

Further, a distance D1 between the inner circumferential surface of the first conveying belt 51 and the leading end of the fin 31 is smaller than a radius D2 of the driven roller 55 (or of the driven roller 54). In addition, the axial center of the driven roller 55 or the driven roller 54 is located at a position to separate from the fin 31 relative to the inner circumferential surface of the first conveying belt 51 stretched between the driven rollers 54 and 55.

Further, the leading ends of the fins 31 are disposed facing the inner circumferential surface of the first conveying belt 51, and the distance D1 between the leading end of each fin 31 and the inner circumferential surface of the first conveying belt 51 is identical to the multiple fins 31. In other words, a direction in which the leading ends of the multiple fins 31 is parallel to a moving direction of the first conveying belt 51.

Accordingly, since the inner circumferential surface of the first conveying belt 51 is disposed close to the leading end of each fin 31, the cooling device 9B can reduce in size in a direction intersecting the sheet conveying direction.

It is to be noted that the first conveying belt 51 that functions as a common conveying belt can be applied to the configurations of the cooling device 9 illustrated in FIGS. 4 through 8.

The configurations according to the above-described embodiments include the first cooler 30 and the second cooler 40 having different cooling types from each other but are not limited thereto.

Figure 12A:
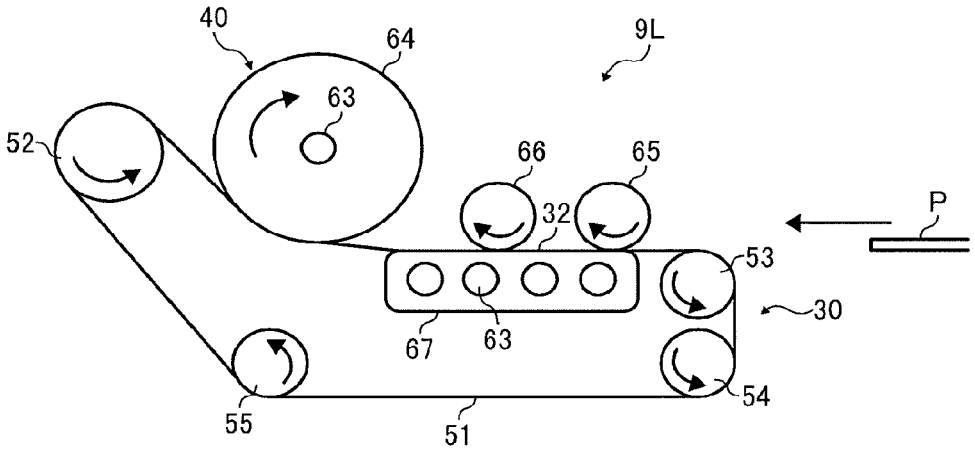
FIG. 12A is a side view illustrating a cooling device provided with a first cooler and a second cooler both employing a liquid cooling method, viewed from a front of the image forming apparatus.
Figure 12B:
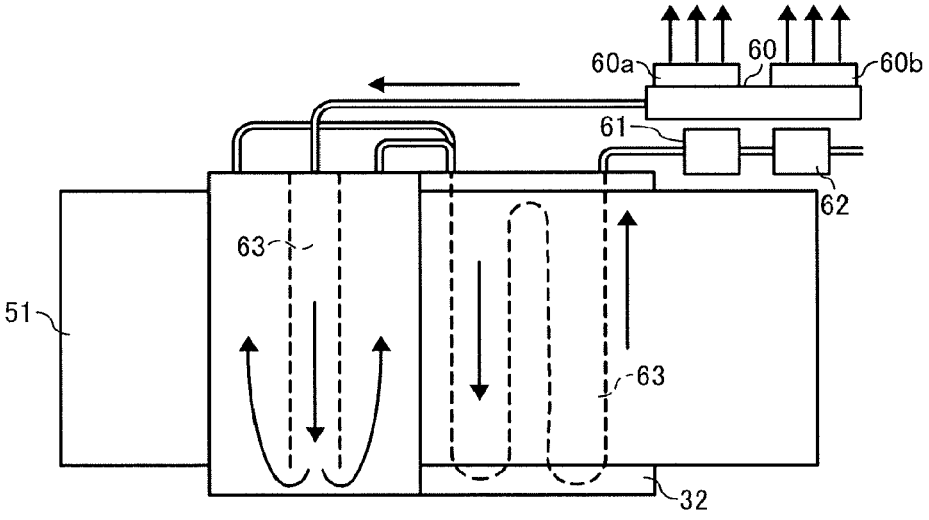
FIG. 12B is a plan view illustrating the cooling device of FIG. 12A, viewed from the top of the image forming apparatus.

FIG. 12A is a side view illustrating a cooling device 9L provided with the first cooler and the second cooler 40 both employing a liquid cooling method, viewed from a front of the image forming apparatus 1000. FIG. 12B is a plan view illustrating the cooling device 9L of FIG. 12A, viewed from the top of the image forming apparatus 1000.

For example, the heat pipe roller (i.e., the second cooler 40) illustrated in FIG. 4A may be replaced with the liquid type rotary cooling device illustrated in FIG. 5, as illustrated in FIGS. 12A and 12B.

As illustrated in FIG. 12A, liquid that is cooled by the radiator 60 flows through an inner passage of the liquid flowing passage 63 of the second cooler 40 that is disposed at the downstream side of the sheet conveying direction. Then, the cooled liquid flows through an outer passage of the liquid flowing passage 63 to be discharged to an outside the second cooler 40. The discharged liquid enters the liquid flowing passage 63 of the first cooler 30 disposed at the upstream side of the sheet conveying direction. At this time, the liquid enters from the extreme downstream inlet port in the sheet conveying direction of the liquid flowing passage 63. Then, the liquid is discharged from the extreme upstream outlet port in the sheet conveying direction of the liquid flowing passage 63. Thereafter, the liquid passes through the tank 61 and the pump 62, and eventually reaches the radiator 60 in which the liquid is cooled.

The first cooler 30 includes the first heat absorbing face 32 having a shape that is different from the shape of a second heat absorbing face 64 of the second cooler 40. When conveying the recording medium P, the second heat absorbing face 64 directly contacts the recording medium P.

In the configuration of FIGS. 12A and 12B, the ejecting direction of the recording medium P from the cooling device 9L can be changed so that the recording medium is ejected from the cooling device 9L in a different direction from the entering direction. In addition, the upstream and downstream belts and the drive roller can be used in common by the first cooler 30 and the second cooler 40, an increase in size of the image forming apparatus 1000 can be restrained. Therefore, the cooling efficiency is enhanced.

The cooling device 9L of FIGS. 12A and 12B includes the first cooler 30, the second cooler 40, the first conveying belt 51, and the drive roller 52. Specifically, the first cooler 30 includes the first heat absorbing face 32 that cools the back face side of the recording medium P (i.e., the non-image forming face in the single-side printing job). The second cooler 40 is disposed downstream from the first cooler 30 in the sheet conveying direction and includes the second heat absorbing face 64 that cools the front face side of the recording medium P (i.e., the image forming face in the single-side printing job). The first heat absorbing face 32 of the first cooler 30 and the second heat absorbing face 64 of the second cooler 40 have different shapes from each other. The first conveying belt 51 has the inner circumferential surface that contacts and slides on the first heat absorbing face 32 of the first cooler 30 and the outer circumferential surface that contacts the second heat absorbing face 64 to hold and convey the recording medium P together. The drive roller 52 functions as a belt driving body to drive the first conveying belt 51. In addition, both the first cooler 30 and the second cooler 40 include the liquid flowing passages 63 through which fluid (liquid) flows. The liquid flowing passage 63 in the first cooler 30 and the liquid flowing passage 63 in the second cooler 40 are formed in the direction intersecting the sheet conveying direction.

Further, the configuration of the cooling device 9L is not limited to the configurations according to the above-described embodiments.

For example, the position of the first cooler 30 and the position of the second cooler 40 in the sheet conveying direction (i.e., in the horizontal direction) may be switched, like the configuration illustrated in FIG. 7. Further, the position of the first cooler 30 and the position of the second cooler 40 in the vertical direction may be switched, like the configuration illustrated in FIG. 8.

Figure 13:
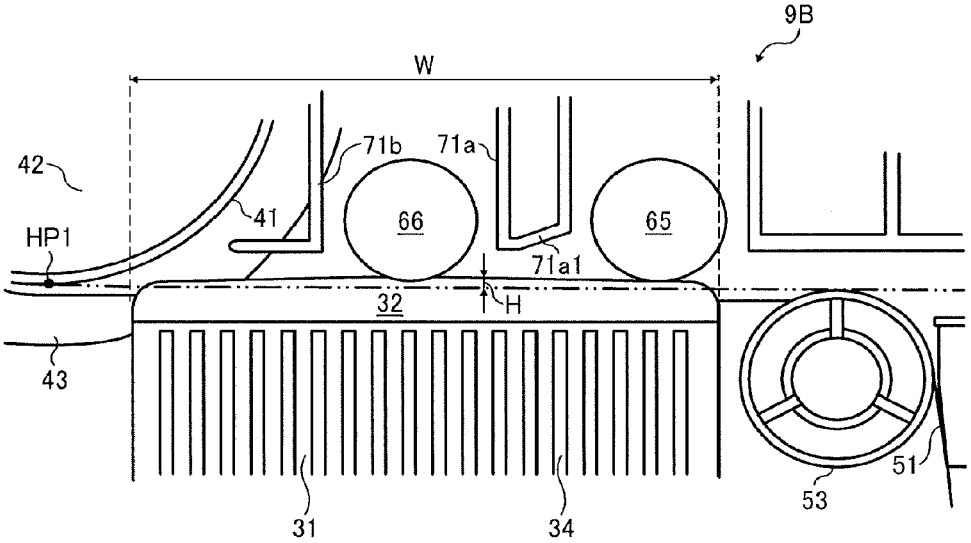
FIG. 13 is a partial enlarged view illustrating the cooling device of FIG. 11A.
Figure 14:
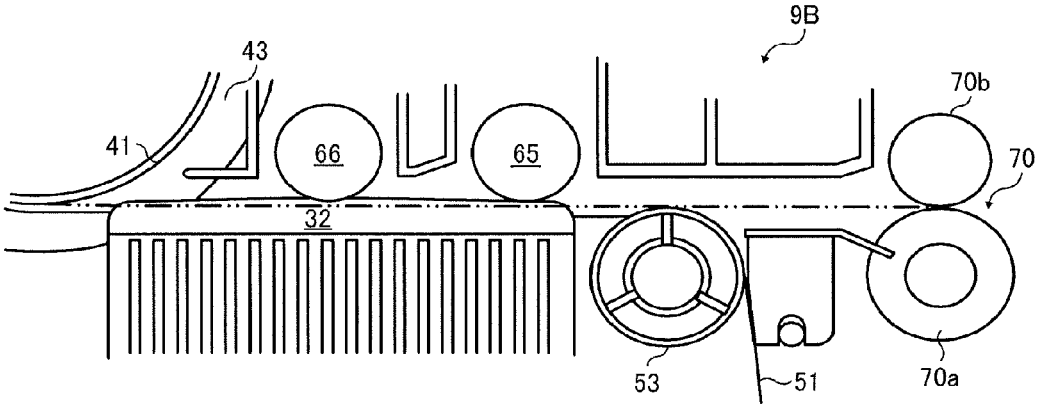
FIG. 14 is a schematic view illustrating the cooling device and a support roller of FIG. 13.

FIG. 13 is a partial enlarged view illustrating the cooling device 9B of FIG. 11A. FIG. 14 is a schematic view illustrating the cooling device 9B and a support roller 70 of FIG. 13.

As illustrated in FIG. 13, the first heat absorbing face 32 of the first cooler 30 includes a width W extending in the sheet conveying direction. The first heat absorbing face 32 has a curved shape having a center projecting upwardly by a height H relative to an upstream end (a right end in FIG. 13) thereof and a downstream end (a left end in FIG. 13) thereof in the sheet conveying direction. Further, a contact start position HP1 of the first conveying belt 51 and the second heat absorbing face 41 of the second cooler 40 is located on an extension of a virtual line (a two-dot chain line in FIG. 13) connecting the upstream end and the downstream end of the first heat absorbing face 32 in the sheet conveying direction.

The upstream end and the downstream end of the first heat absorbing face 32 are projecting start positions of the first heat absorbing face 32. Alternatively, as illustrated in FIG. 14, the support roller 70 is disposed between the fixing device 8 and the cooling device 9B to convey the recording medium P. In this configuration, the upstream end and the downstream end of the first heat absorbing face 32 may be located at respective positions intersecting a virtual line connecting a nip region of the support roller 70 and the contact start position HP1 on the second cooler 40. At this time, the contact start position HP1 on the second cooler 40 is located upstream from the extreme downstream position of the second cooler 40 in the direction of rotation of the second cooler 40.

As a result, a contact width of the first heat absorbing face 32 and the first conveying belt 51 can be increased and the recording medium P can contact the first heat absorbing face 32 reliably. Therefore, the recording medium P can be cooled more efficiently.

A sheet transfer guide 71*a* is disposed between the sheet conveying rollers 65 and 66. A lower end of the sheet transfer guide 71*a* includes an inclined surface 71*a*1 that inclines downward from the upstream side to the downstream side of the sheet conveying direction. In other words, the inclined surface 71*a*1 has a shape of which a distance between the first heat absorbing face 32 and the sheet transfer guide 71*a* is reduced from the upstream side to the downstream side of the sheet conveying direction. Since the upstream end of the first heat absorbing face 32 is projected, when the leading end of the recording medium P enters the nip region of the sheet conveying roller 65 and the first heat absorbing face 32, an upward force is applied to the leading end of the recording medium P. Therefore, it is likely that, depending on a type of the recording medium P, the leading end of the recording medium P is likely to be lifted by the stiffness of the recording medium P after the recording medium P has passed the sheet conveying roller 65. However, due to the shape of the lower end of the sheet transfer guide 71*a*, the leading end of the recording medium P can be guided to the nip region of the sheet conveying roller 66 and the first heat absorbing face 32.

A sheet transfer guide 71*b* is disposed between the sheet conveying rollers 66 and the second heat absorbing face 41. A lower end of the sheet transfer guide 71*b* includes a substantially horizontal face from the upstream side to the downstream side of the sheet conveying direction. Further, the downstream end of the sheet transfer guide 71*b* in the sheet conveying direction is located closer toward a shaft center of the fin 43 of the second cooler 40 from the outer circumferential surface of the fin 43 of the second cooler 40. Accordingly, the downstream end of the sheet transfer guide 71*b* in the sheet conveying direction can be positioned closer to the second heat absorbing face 41, and therefore the leading end of the recording medium P can be guided to the contact start position HP1 reliably.

It is to be noted that the sheet transfer guides 71*a* and 71*b* may be included in the cooling devices 9 having the configurations illustrated in FIGS. 2 and 4 through 8 and having respective configurations described below.

Further, the second cooler 40 includes a heat pipe roller. Therefore, the first conveying belt 51 can slidably move along the outer circumferential surface of the second cooler 40, following the shape of the downstream side of the first heat absorbing face 32 of the first cooler 30 in the sheet conveying direction. Therefore, the first heat absorbing face 32 of the first cooler 30 can contact the first conveying belt 51 in the sheet conveying direction. Consequently, the recording medium P can be cooled more efficiently.

In FIG. 14, the support roller 70 is disposed upstream from the first cooler 30 in the sheet conveying direction. The support roller 70 functions as a sheet conveying body having a rotary body to hold and convey the recording medium P after the recording medium P has passed the fixing device 8. The rotary body of the support roller 70 includes a drive roller 70*a* and a driven roller 70*b*. The drive roller 70*a* is driven by a drive source that is different from the drive source that drives the drive roller 52 of the cooling device 9B.

A speed of rotation of the second cooler 40 that is rotated by movement of the first conveying belt 51 is greater than a speed of rotation of the drive roller 70*a*. Accordingly, the recording medium P is conveyed between the second cooler 40 and the support roller 70 with tension, and therefore can contact the first cooler 30 more reliably.

Thus, by providing a rotary body driving device that is different from a rotary body driving device for driving a belt driving body, fine control can be performed. For example, a magnitude relation of a linear velocity of the drive roller 70*a* and a linear velocity of the first conveying belt 51 can be changed according to a type of the recording medium P.

By contrast, the drive roller 70*a* and the drive roller 52 of the cooling device 9B may be driven by a common driving method. A detailed description of a case in which the drive roller 70*a* and the drive roller 52 of the cooling device 9B are driven by a single common drive source and a case in which the drive roller 70*a* and the drive roller 52 of the cooling device 9B are driven by different drive sources is given below.

As described above, the speed of rotation of the second cooler 40 that is rotated by movement of the first conveying belt 51 is greater than the speed of rotation of the drive roller 70*a*. Further, a speed of movement of the first conveying belt 51 is substantially same as the speed of rotation of the second cooler 40. Accordingly, this configuration can prevent the leading end of the recording medium P from bending when the leading end of the recording medium P enters the second cooler 40.

Figure 21:
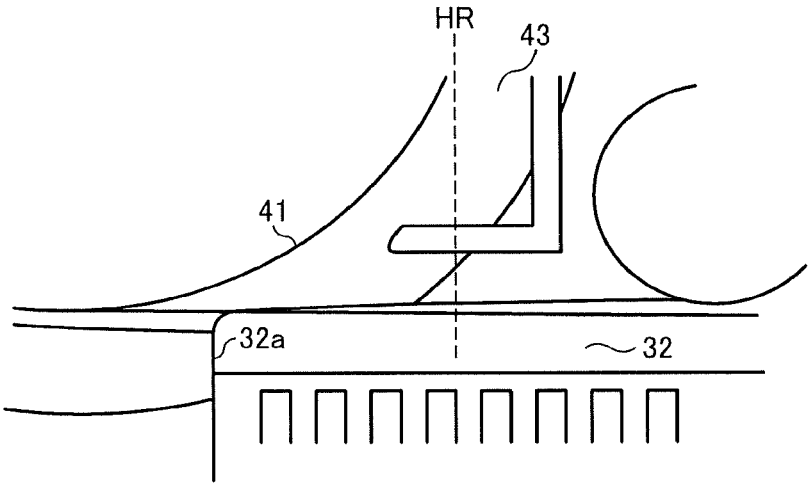
FIG. 21 is an enlarged view illustrating a downstream side end of a first heat absorbing surface of the first cooler and a lower part of the second cooler.

Further, the smallest gap of 2 mm or greater is preferably provided between the second heat absorbing face 41 and the first heat absorbing face 32. Accordingly, this configuration can prevent the leading end of the recording medium P from bending when the leading end of the recording medium P enters the second cooler 40 even if a downstream end of the first heat absorbing face 32 and the second cooler 40 are positioned in the relation as illustrated in FIG. 21.

Figure 15:
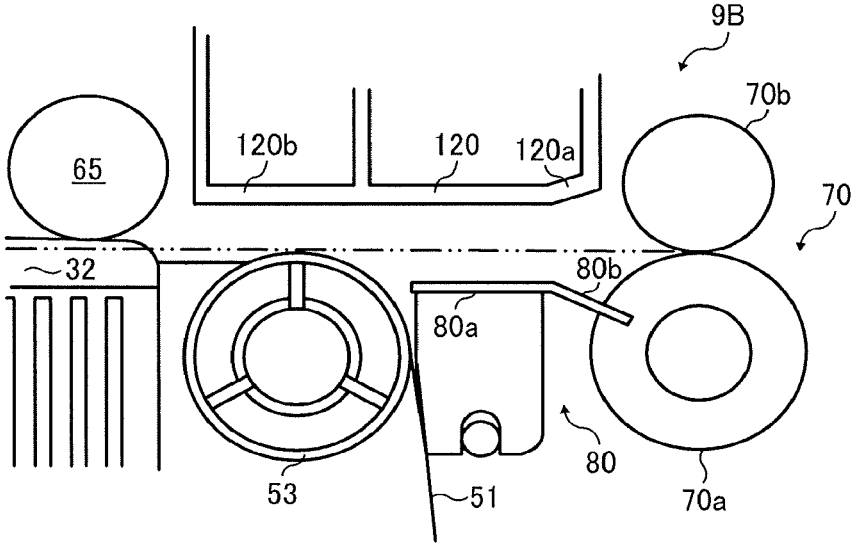
FIG. 15 is a partial enlarged view illustrating the cooling device of FIG. 14.

FIG. 15 is a partial enlarged view illustrating the cooling device 9B of FIG. 14.

A sheet transfer guide 80 is disposed between the support roller 70 and the first cooler 30 so as to guide the recording medium P from the support roller 70 to the first cooler 30. The sheet transfer guide 80 includes guide portions 80*a* and 80*b*. The guide portion 80*a* is substantially flat. The guide portion 80*b* includes a guide face that is inclined upwardly from the upstream side to the downstream side in the sheet conveying direction. The sheet transfer guide 80 is positioned below the sheet conveying direction to guide the back face side of the recording medium to the first cooler 30.

Figure 16:
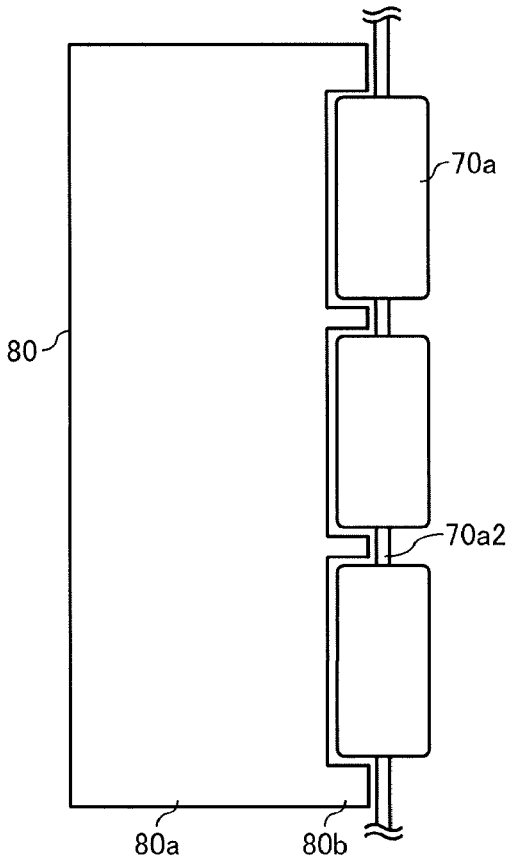
FIG. 16 is a schematic plan view illustrating a sheet transfer guide.

Further, as illustrated in FIG. 16 that is a schematic plan view of the sheet transfer guide 80, there are multiple drive rollers 70*a* disposed separated at predetermined intervals in an axial direction. The upstream end of the guide portion 80*b* in the sheet conveying direction extends toward a shaft 70*a*2 between adjacent drive rollers 70*a*. Accordingly, even when the recording medium P that has passed the support roller 70 is curled downwardly, the sheet transfer guide 80 can guide the leading end of the recording medium P to the first cooler 30 reliably.

In addition, the sheet transfer guide 80 in FIG. 15 is disposed so as not to project over a virtual line (a two-dot chain line in FIG. 15) connecting the nip region of the support roller 70 and the contact start position HP1 on the second cooler 40. Accordingly, this configuration can prevent the back face side of the recording medium P from sliding and abrading with the sheet transfer guide 80 and resulting in damage or scratch on the image of the recording medium P.

It is to be noted that a sheet transfer guide 120 is disposed above the virtual line (the two-dot chain line in FIG. 15). An upstream end of the sheet transfer guide 120 in the sheet conveying direction includes an inclined surface 120*a* that is inclined downwardly to guide the leading end of the recording medium P to the downstream side of the sheet conveying direction. A lower end 120*b* that is a rest of the upstream end of the sheet transfer guide 120 in the sheet conveying direction has a substantially horizontal face.

Further, the sheet transfer guide 80 is not limited to the above-described shape. For example, as illustrated in FIG. 17A, the sheet transfer guide 80 may be linearly be inclined entirely from the upstream side to the downstream side in the sheet conveying direction.

Figure 17A:
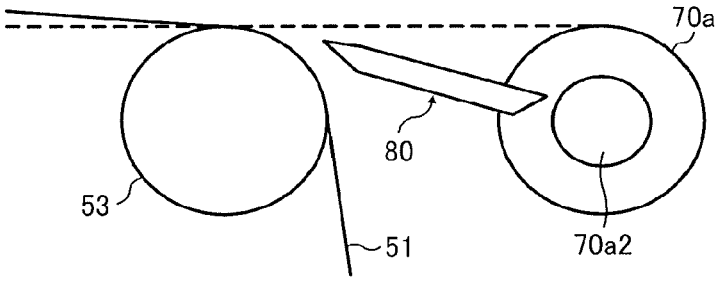
FIG. 17A is a side view illustrating a variation of the sheet transfer guide.
Figure 17B:
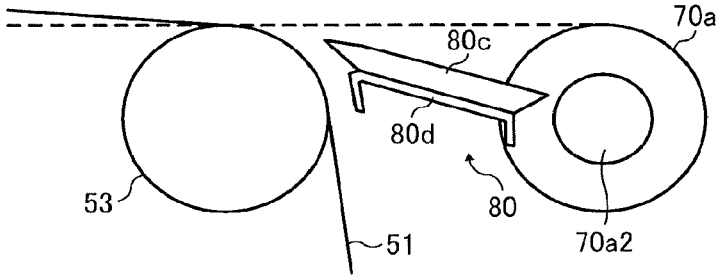
FIG. 17B is a side view illustrating the sheet transfer guide attached to a base.
Figure 17C:
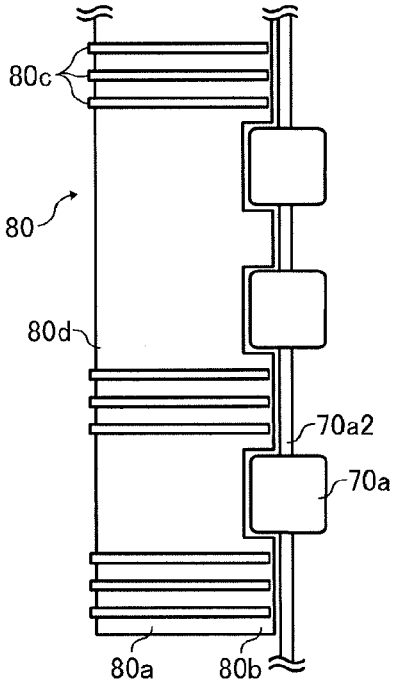
FIG. 17C is a top view illustrating the sheet transfer guide partly attached to the base.

FIG. 17A is a side view illustrating a variation of the conveyance guide 80. FIG. 17B is a side view illustrating the conveying guide 80 attached to a base 80*d*. FIG. 17C is a top view illustrating the conveying guide 80 partly attached to the base 80*d*.

According to this configuration, the downstream end of the sheet transfer guide 80 in the sheet conveying direction can be located closer to the driven roller 53. Accordingly, the leading end of the recording medium P can be guided to upwards over the driven roller 53.

Further, as illustrated in FIG. 17B, the sheet transfer guide 80 may include a guide part 80*e* and the base 80*d* on which the guide part 80*c* is mounted. According to this configuration, when the guide part 80*c* is stained or deteriorated, the guide part 80*c* can be replaced without removing the base 80*d*.

By contrast, as illustrated in FIG. 17C, multiple guide parts 80*c* can be disposed partly in the direction intersecting the sheet conveying direction. Each guide part 80*e* extends in the sheet conveying direction and includes a material different from the base 80*d*. For example, the guide part 80*c* preferably includes a material to which a smaller amount of toner adheres.

When compared with the configuration illustrated in FIG. 16, the drive roller 70*a* illustrated in FIG. 17C has a smaller width in the axial direction. According to this configuration, a contact area in which the recording medium P after the fixing device 8 contacts the support roller 70 or the guide part 80*c* of the sheet transfer guide 80 may be smaller than the contact area described above. Accordingly, the image formed on the recording medium P can be less scratched or stained.

It is to be noted that the guide part 80*c* may expand outwardly to the center in the width direction that intersects with the sheet conveying direction.

Figure 18:
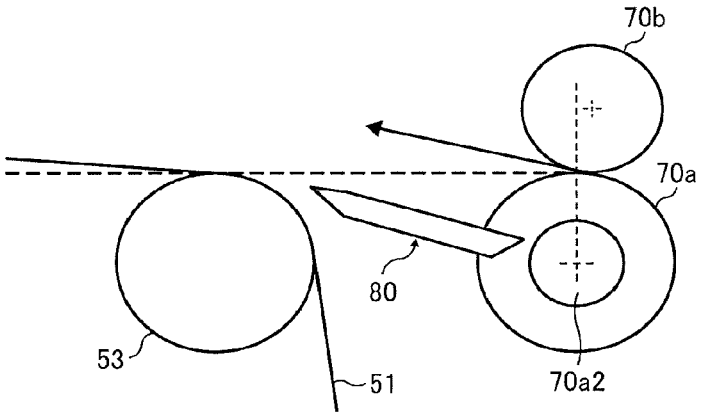
FIG. 18 is a schematic view illustrating a variation of the support roller.

FIG. 18 is a schematic view illustrating a variation of the support roller 70.

As illustrated in FIG. 18, the center of rotation of the driven roller 70*b* may be disposed shifted from the center of rotation of the drive roller 70*a* to the upstream side of the sheet conveying direction. Specifically, the cooling device 9 includes the support roller 70 that functions as a conveyance body including the drive roller 70*a* that functions as a first rotary body and the driven roller 70*b* that functions as a second rotary body. The drive roller 70*a* and driven roller 70*b* are disposed upstream from the first cooler 30 in the sheet conveying direction to hold and convey the recording medium P that has passed through the fixing device 8. The drive roller 70*a* is disposed near the first cooler 30 to the recording media conveying passage. The driven roller 70*b* is disposed near the second cooler 40 to the recording media conveying passage. The center of rotation of the driven roller 70*b* is shifted from the center of rotation of the drive roller 70*a* to the upstream side of the sheet conveying direction. Accordingly, the recording medium P is ejected from the nip region of the support roller 70 with the printed face up, and therefore can be conveyed to the first heat absorbing face 32 of the first cooler 30 more reliably.

Figure 19:
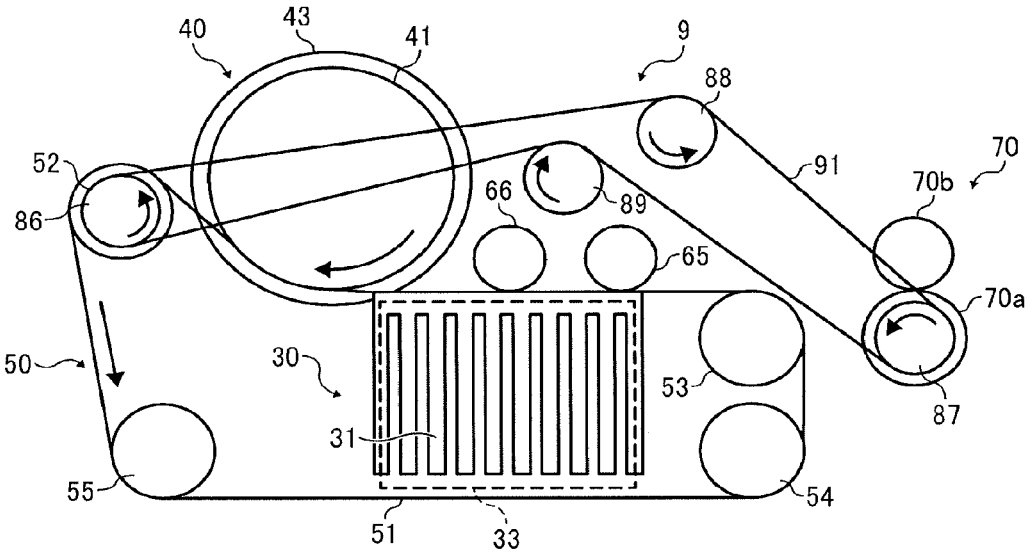
FIG. 19 is a diagram illustrating a case in which a single drive motor drives a drive roller that functions as a belt driving body and a different drive roller that functions as a rotary body.

Next, a detailed description is given of a case in which a single drive source drives both the drive roller 52 that functions as a belt driving body and the drive roller 70*a* that functions as a rotary body, with reference to FIG. 19.

When a driving force that is generated by a drive source is transmitted to the first conveying belt 51, the first conveying belt 51 is moved in the sheet conveying direction along with rotation of the drive roller 52 in the counterclockwise direction in FIG. 19. Further, the driving force is transmitted from a pulley 86 that is coaxially mounted on the drive roller 52 to a pulley 87 that is coaxially mounted on the drive roller 70*a* via a timing belt 91, a pulley 88, and a pulley 89. By so doing, the drive roller 70*a* is rotated in a direction to eject the recording medium P, that is, in the counterclockwise direction. Since the pulleys 88 and 89 are disposed above the sheet conveying rollers 65 and 66, the timing belt 91 is wound around the rollers to bypass an air flow passage to the fan 33 and the fins 31 of the first cooler 30.

By contrast, the second cooler 40 that includes a heat pipe roller is in contact with the first conveying belt 51 and is rotated in the clockwise direction by a frictional force generated between the first conveying belt 51 and the second heat absorbing face 41 of the second cooler 40. The recording medium P discharged from the fixing device 8 is conveyed by the drive roller 70*a* and the driven roller 70*b* to the downstream side in the sheet conveying direction. Then, the recording medium P is held and conveyed by the second cooler 40 and the first conveying belt 51 to be conveyed to a further downstream side in the sheet conveying direction.

The surface speed of the first conveying belt 51 is determined based on at least the diameter of the drive roller 52, the thickness of the first conveying belt 51, and the number of rotations of the drive roller 52.

Further, the surface speed of the drive roller 70*a* is determined based on at least the diameter of the drive roller 70*a* and the number of rotations of the drive roller 70*a*. The number of rotations of the drive roller 70*a* is determined based on the number of rotations of the drive roller 52 and a ratio of teeth of the pulley 86 and teeth of the pulley 87.

Consequently, by taking slippage due to friction when the heat absorbing surface 41 contacts the surface of the first conveying belt 51 into consideration, the surface speed (i.e., the speed of the surface of the heat absorbing surface 41) of the second cooler 40 is substantially same as the surface speed of the first conveying belt 51.

In the configuration illustrated in FIG. 19, when the surface speed of the drive roller 70*a* is greater than the surface speed of the first conveying belt 51, the recording medium P that is held and conveyed by the drive roller 70*a* and the driven roller 70*b* is bent (curved like waves) within a section from a holding position of the sheet conveying rollers 65 and 66 and the first conveying belt 51 to the drive roller 70*a*. This might reduce the contact area of the recording medium P to the first cooler 30.

In order to restrain the bending of the recording medium P in that section, the surface speed of the drive roller 70*a* is preferably set to be smaller than the surface speed of the first conveying belt 51.

For example, when a sum of the diameter of the drive roller 52 and the thickness of the first conveying belt 51 is the same as the diameter of the drive roller 70*a*, the (reduction) ratio of the number of teeth of the pulley 87 and the number of teeth of the pulley 86 is set to be greater than 1.

Alternatively, when the (reduction) ratio of the number of teeth of the pulley 86 and the number of teeth of the pulley 87 is set to 1, the sum of the diameter of the drive roller 52 and the thickness of the first conveying belt 51 is set to be greater than the diameter of the drive roller 70*a*.

Alternatively, when the sum of the diameter of the drive roller 52 and the thickness of the first conveying belt 51 is set to be smaller than the diameter of the drive roller 70*a*, the number of teeth of the pulley 87 is set to be greater than the number of teeth of the pulley 86 so that the surface speed of the drive roller 70*a* is smaller than the surface speed of the first conveying belt 51.

According to the above-described driving methods, the number of parts are reduced and the size of the image forming apparatus 1000 or the cooling device 9 can be reduced.

Next, a detailed description is given of a case in which the drive roller 70*a* that functions as a belt driving body and the drive roller 70*a* that functions as a rotary body are driven by different drive sources. This case can be applied to the configurations of the embodiments with reference to FIGS. 2A, 2B, 9, 11A, and 11B.

In this case, the cooling device 9 includes the support roller 70 that functions as a sheet conveying body in addition to the drive roller 52 that functions as a belt driving body. The support roller 70 in this case is disposed upstream from the first cooler 30 in the sheet conveying direction and includes the drive roller 70*a* that functions as a rotary body and a rotary body driving device to rotate the drive roller 70*a*. The drive roller 70*a* holds and conveys the recording medium P after the recording medium P has passed the fixing device 8. This configuration does not include the pulleys 86, 87, 88, and 89 and the timing belt 91 illustrated in FIG. 19.

The surface speed of the first conveying belt 51 is determined based on at least the diameter of the drive roller 52, the thickness of the first conveying belt 51, and the number of rotations of the drive roller 52. The surface speed of the drive roller 70*a* is determined based on at least the diameter of the drive roller 70*a* and the number of rotations of the drive roller 70*a*.

According to this configuration, the surface speed of the drive roller 70*a* can be set to be smaller than the surface speed of the first conveying belt 51 as follows.

For example, when the sum of the diameter of the drive roller 52 and the thickness of the first conveying belt 51 equals to the diameter of the drive roller 70*a*, the number of rotations of the drive roller 70*a* is set to be smaller than the number of rotations of the drive roller 52.

Further, when the number of rotations of the drive roller 52 equals to the number of rotations of the drive roller 70*a*, the sum of the diameter of the drive roller 52 and the thickness of the first conveying belt 51 is set to be greater than the diameter of the drive roller 70*a*.

Alternatively, when the sum of the diameter of the drive roller 52 and the thickness of the first conveying belt 51 is smaller than the diameter of the drive roller 70*a*, the number of rotations of the drive roller 70*a* is set to be smaller than the number of rotations of the drive roller 52 so that the surface speed of the drive roller 70*a* is smaller than the surface speed of the first conveying belt 51.

Thus, by providing different rotary body driving devices to perform the above-described driving operations, the number of rotations of the drive roller 52 and the number of rotations of the drive roller 70*a* can be controlled by the fine control. For example, a magnitude relation of a linear velocity of the drive roller 70*a* and a linear velocity of the first conveying belt 51 can be changed according to a type of the recording medium P.

Figure 20:
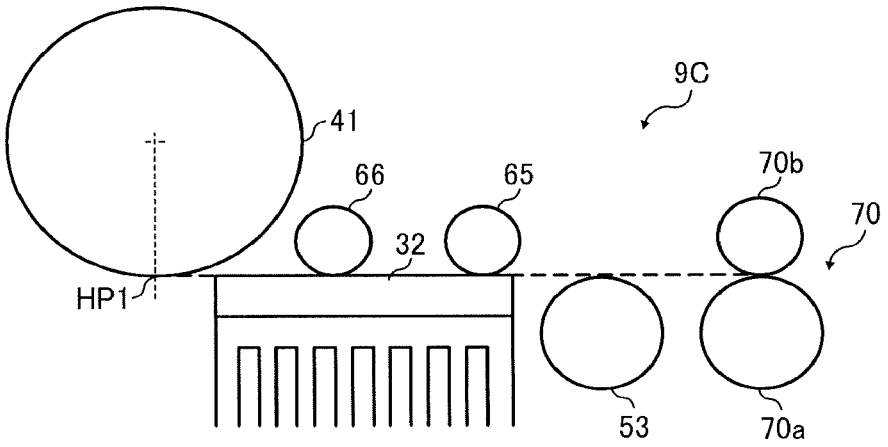
FIG. 20 is a schematic view illustrating a variation of the cooling device of FIG. 13 and FIG. 14.

FIG. 20 is a schematic view illustrating a cooling device 9C as a variation of the cooling device 9B of FIGS. 13 and 14.

As illustrated in FIG. 20, the center of an upper face of the first heat absorbing face 32 of the first cooler 30 may be flat-shaped, so that the upper face of the first heat absorbing face 32 may be located on a virtual line (a dashed line in FIG. 20) connecting a nip position of the support roller 70 and the contact start position HP1 of the second cooler 40 to the first conveying belt 51. At this time, the contact start position HP1 is located at a lowest point of the second cooler 40. The lowest position indicates, for example, an intersection of a vertical line extending downwardly from the center of rotation of the second heat absorbing face 41 and an outer circumference of the second heat absorbing face 41. Accordingly, a drive torque to drive the first conveying belt 51 is reduced and the belt durability is enhanced since the back face side of the first conveying belt 51 is not pressed hard against the first heat absorbing face 32.

FIG. 21 is an enlarged view illustrating a downstream end 32*a* of the first heat absorbing surface 32 of the first cooler 30 and the lower part of the second cooler 40.

When a direction from an upstream end to the downstream end 32*a* of the first heat absorbing face 32 in the sheet conveying direction represents a width direction (that is, a horizontal direction in the drawing), the downstream end 32*a* of the first heat absorbing face 32 is located within the width of the second cooler 40 in the width direction (the horizontal direction in the drawing). In other words, the downstream end 32*a* of the first heat absorbing face 32 is located downstream from an extreme upstream position HR of the second cooler 40 in the sheet conveying direction. To be more specific, the downstream end 32*a* of the first heat absorbing face 32 is located closer to the center of the axis of the second cooler 40 than the outer circumferential surface of the fin 43 of the second cooler 40.

According to this configuration, the first cooler 30 and the second cooler 40 can be located relatively closer to each other in the sheet conveying direction. Therefore, a reduction in size of the cooling device and a higher cooling effect can be achieved simultaneously.

Figure 22:
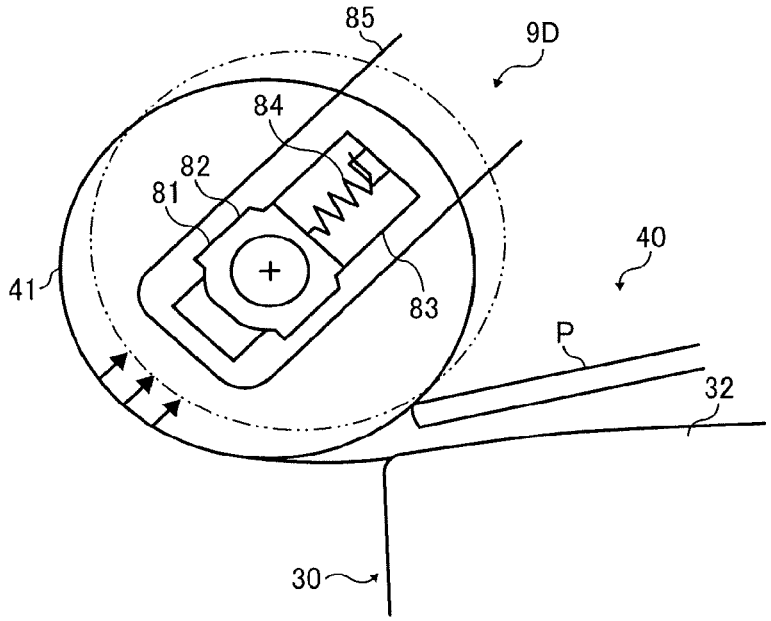
FIG. 22 is a schematic view illustrating a variation of the cooling device of FIG. 11.

FIG. 22 is a schematic view illustrating a cooling device 9D as a variation of the cooling device 9B of FIGS. 11A and 11B.

In the cooling device 9D, the second cooler 40 functions as a rotary body that is rotated with movement of the first conveying belt 51 and that conveys the recording medium P while holding between the second heat absorbing face 41 and the first conveying belt 51. The second cooler 40 can move in the same direction as a through-thickness direction of the first conveying belt 51.

The image forming apparatus 1000 according to an embodiment of this disclosure is capable of conveying recording media of any thickness of from thin paper to thick paper. However, when the downstream end of the first cooler 30 is located significantly close to the second cooler 40, a distance between the first cooler 30 and the second cooler 40 is reduced. Therefore, it is likely that the recording medium P is rubbed between the first cooler 30 and the second cooler 40.

In order to address this inconvenience, the cooling device 9D can move in the same direction as the through-thickness direction of the first conveying belt 51 on the first heat absorbing face 32, as illustrated in FIG. 22. By so doing, the second cooler 40 can move according to the thickness of the recording medium P. Accordingly, a mechanical stress to the recording medium P is reduced, and therefore a belt driving load can be restrained.

Specifically, the image forming apparatus 1000 includes a sheet metal 85, a bearing 81, a bearing holder 82, a spring 84. The sheet metal 85 has a guide opening 83 and is secured to the image forming apparatus 1000. The bearing 81 supports a shaft end of the heat pipe roller, i.e., the second cooler 40. The bearing holder 82 holds the bearing 81. The bearing holder 82 is biased by the spring 84 to be movable in the guide opening 83. One end of the spring 84 is secured to the guide opening 83 and the opposite end of the spring 84 is secured to the bearing holder 82. According to this configuration, when the second cooler receives a force greater than the biasing force of the spring 84 from the recording medium P, the second cooler 40 can move in a longitudinal direction of the guide opening 83 or in a direction indicated by arrow in FIG. 22.

Figure 23:
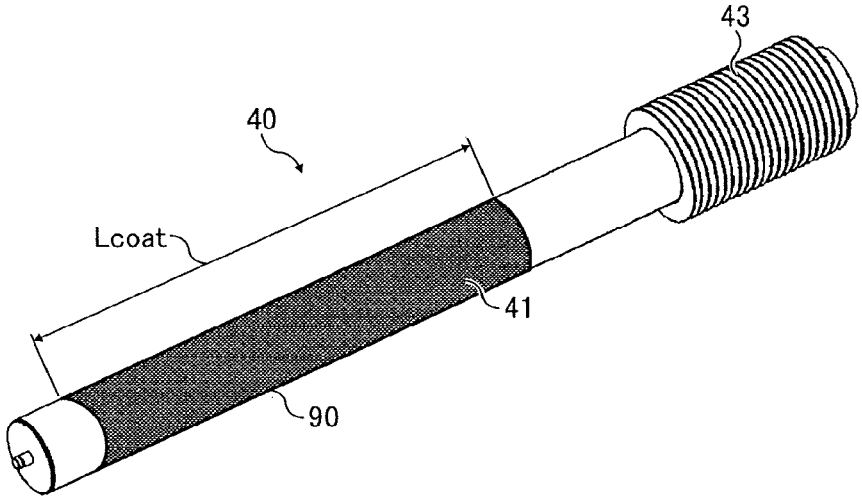
FIG. 23 is a perspective view illustrating a heat pipe roller included in the second cooler.

FIG. 23 is a perspective view illustrating the heat pipe roller, that is, the second cooler 40.

The second cooler 40 is a rotary body that is rotated with movement of the first conveying belt 51 and that holds and conveys the recording medium P together with the second heat absorbing face 41 and the first conveying belt 51. An outer surface of the second heat absorbing face 41 of the second cooler 40 includes a coat layer 90.

As illustrated in FIG. 23, the outer surface of the second heat absorbing face 41 of the second cooler 40 includes a coat layer 90. A region Lcoat of the coat layer 90 is formed greater than a width of conveyance of the recording medium P and a greater region than the region Lcoat is unwanted. Further, the coat layer 90 includes a material to which toner does not easily adhere, for example, high-release glass coating agent (SiO2). When the heat pipe roller (i.e., the second cooler 40) is disposed facing a toner image formed on the recording medium P, the second cooler 40 contacts the surface of the recording medium P on which a half melted toner image is formed. However, by providing the coat layer 90 on the outer surface of the second heat absorbing face 41 of the second cooler 40, the coat layer 90 can prevent the half melted toner image from adhering to the second cooler 40. It is to be noted that the heat pipe roller (i.e., the second cooler 40) may be provided to the front face side of the recording medium P (the image forming face in the single-side printing job) or to the back face side of the recording medium P (the non-image forming face in the single-side printing job). When the heat pipe roller (i.e., the second cooler 40) is mounted on the front face side of the recording medium P (the image forming face in the single-side printing job), the coat layer 90 contacts the toner image formed on the recording medium P even in the single-side printing job. Further, when the heat pipe roller (i.e., the second cooler 40) is mounted on the back face side of the recording medium P (the non-image forming face in the single-side printing job), the coat layer 90 contacts the toner image formed on the recording medium P in a duplex printing job.

The first conveying belt 51 includes a thin film resin material such as polyimide. Further, in order to restrain uneven gloss on the back face side of the recording medium P, the arithmetic average roughness (Ra) on the front face side of the first conveying belt 51 is set to be in a range of from 0.4 μm through 3.2 μm, more preferably, in a range of from 0.6 μm through 1.9 μm.

Due to the relation of the coat layer 90 and the first conveying belt 51, even when the recording medium P is not held by the second heat absorbing face 41 and the first conveying belt 51, the second heat absorbing face 41 can be prevented from adhering to the first conveying belt 51.

Alternative to the coat layer 90, the surface treatment may be applied to the second heat absorbing face 41 of the second cooler 40. For example, a fluorinated tube may be shrunk by heat shrink to be attached to the outer circumference of the second heat absorbing face 41. This configuration can also obtain the same effect as the above-described configuration with the coat layer 90.

Figure 24:
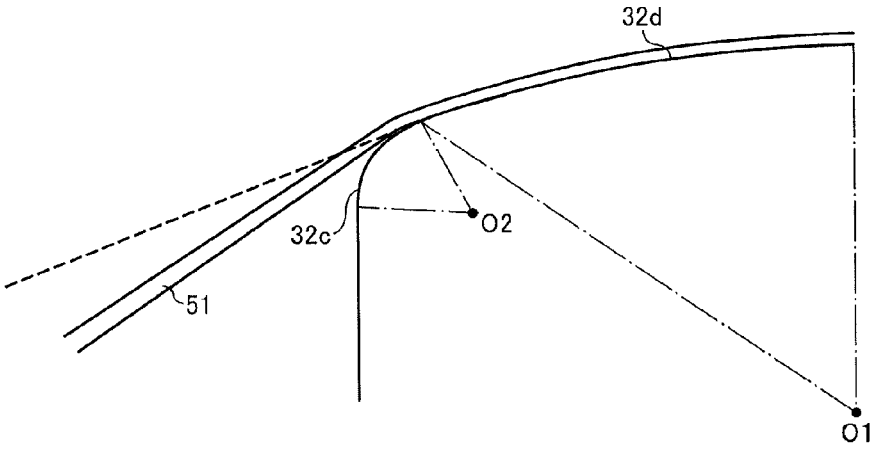
FIG. 24 is an enlarged view illustrating a downstream side of the first heat absorbing surface of the first cooler in the sheet conveying direction.

FIG. 24 is an enlarged view illustrating a downstream side of the first heat absorbing surface 32 of the first cooler 30 in the sheet conveying direction.

As illustrated in FIG. 24, the first heat absorbing face 32 includes a main cooling face 32*d* and an auxiliary cooling face 32*c*. Both the upstream end and the downstream end of the first heat absorbing face 32 in the sheet conveying direction have respective curved surfaces. The main cooling face 32*d* includes a face having a radius of curvature R1 centered on a virtual center O1 and the auxiliary cooling face 32*c* includes a face having a radius of curvature R2 centered on a virtual center O2 (R1>R2). For example, the radius of curvature R1 equals to 754.8 mm and the radius of curvature R2 equals to 2 mm.

By providing the auxiliary cooling face 32*c*, the first conveying belt 51 is tensioned downwardly hard so that a relatively large tension force applied by the first conveying belt 51 is maintained. Further, the first conveying belt 51 can contact the auxiliary cooling face 32*c*. Since the auxiliary cooling face 32*c* has a curved surface, rapid wear of the first conveying belt 51 caused when both ends of the main cooling face 32*d* have sharp corners can be prevented.

Further, scratch or damage to the back face side of the first conveying belt 51 due to stress concentration to the upstream end and the downstream end of the first heat absorbing face 32 can be prevented.

Further, by effectively using the entire region of the main cooling face 32*d* in the sheet conveying direction, a higher cooling effect can be provided.

Figure 25:
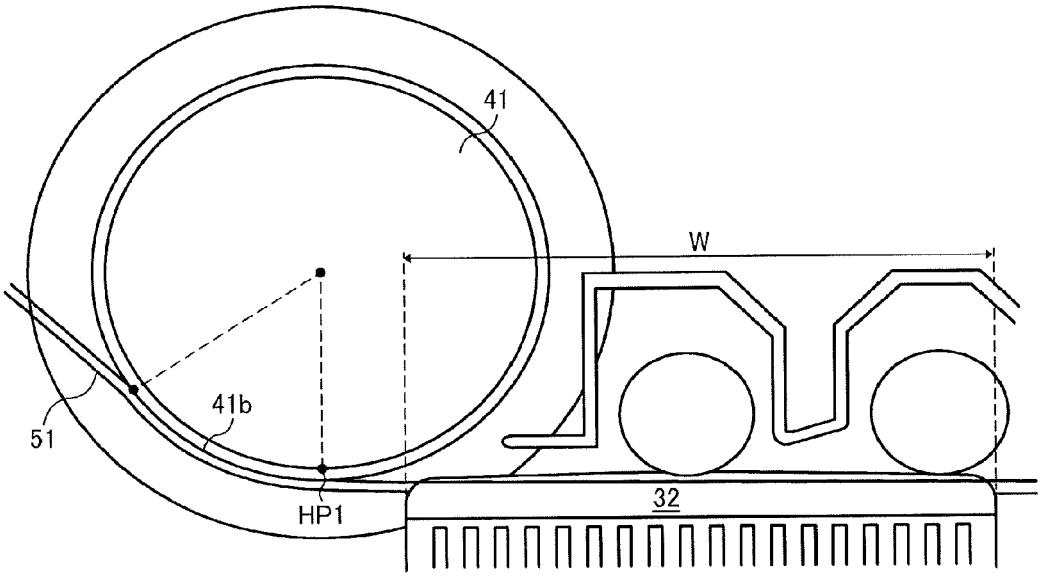
FIG. 25 is a partial enlarged view illustrating the cooling device of FIG. 13.

FIG. 25 is a partial enlarged view illustrating the cooling device 9B of FIG. 13.

As illustrated in FIG. 25, the width W in the sheet conveying direction where the first heat absorbing face 32 and the first conveying belt 51 contact to each other is greater than a contact width 41*b* where the second heat absorbing face 41 and the first conveying belt 51 contact to each other.

Accordingly, the cooling effect on the first heat absorbing face 32 increases, adhesion of toner to the second heat absorbing face 41 when the recording medium P enters the contact start position HP1 is restrained, and scratch or damage to the image can be prevented.

Figure 26:
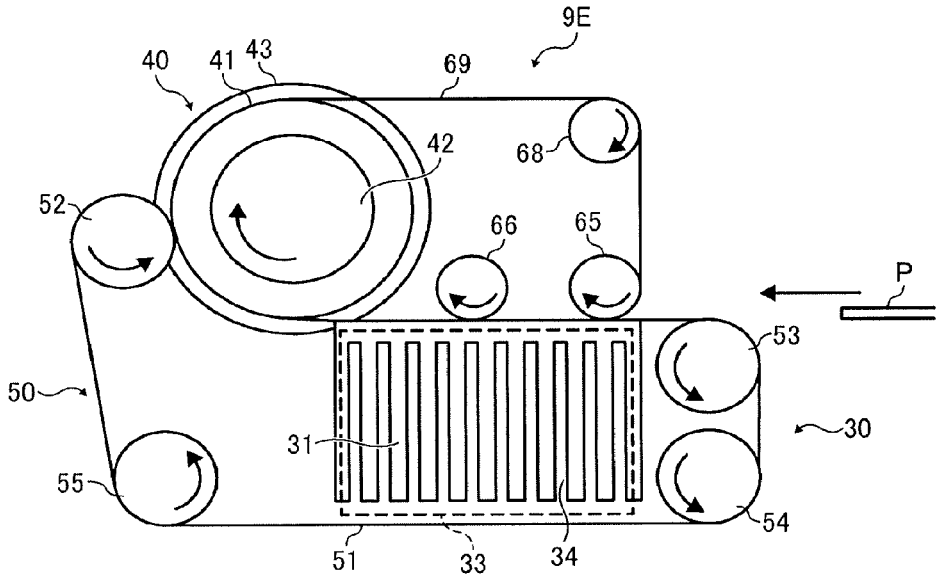
FIG. 26 is a schematic view illustrating of a variation of the cooling device of FIG. 11.

FIG. 26 is a schematic view illustrating of a cooling device 9E as a variation of the cooling device 9B of FIGS. 11A and 11B.

In the cooling device 9B of FIGS. 11A and 11B, the second heat absorbing face 41 of the second cooler 40 directly contacts the recording medium P. By contrast, in the cooling device 9E according to the present embodiment, the second heat absorbing face 41 of the second cooler 40 contacts the recording medium P via a sheet conveying belt 69. The second cooler 40 includes the sheet conveying belt 69 that conveys the recording medium P. The sheet conveying belt 69 includes an inner circumferential surface that is wound around the heat pipe roller (i.e., the second cooler 40), a drive roller 68, and the sheet conveying rollers 65 and 66. The sheet conveying rollers 65 and 66 are rotated with rotation of the drive roller 68. The drive roller 68 is driven by a driving motor to rotate in the clockwise direction, so as to rotate the sheet conveying belt 69 in the clockwise direction.

Alternatively, the drive motor used to drive the drive roller 52 of the first conveying belt 51 may also be the drive source of the drive roller 68. For example, the sheet conveying belt 69 may be rotated along with movement of the first conveying belt 51.

Alternatively, a gear is mounted on the shaft of the drive roller 52, so that the drive roller 52 can be linked to the gear mounted on the drive roller 68 via the gear train.

Accordingly, in addition to the above-described effect, the configuration in which the first conveying belt 51 and the sheet conveying belt 69 hold and convey the recording medium P can reduce abrasion to the toner image on the recording medium P.

Figure 27:
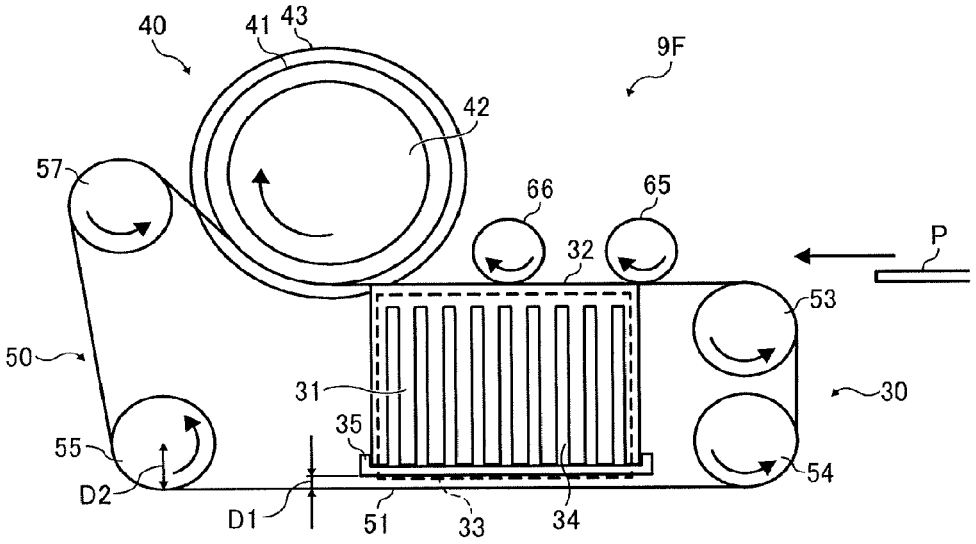
FIG. 27 is a schematic view illustrating of a variation of the cooling device of FIG. 2.

FIG. 27 is a schematic view illustrating of a cooling device 9F as a variation of the cooling device 9B of FIGS. 11A and 11B.

In the cooling device 9B of FIGS. 11A and 11B, the leading end of each fin 31 of the first cooler 30 is uncovered. By contrast, in the cooling device 9F according to the present embodiment, an opening of the leading end of each fin 31 is covered by a cover 35. The cover 35 is disposed across the heat sink (i.e., the first cooler 30) from the front side to the rear side. The fin 31 is surrounded by the cover 35, the heat receiving part 32, and the adjacent fins 31 disposed at both ends of the fin 31 in the sheet conveying direction. Thus, by surrounding the fin 31 by the above-described members, the liquid flowing passage 34 is formed to cause airflow to pass along the fins 31.

Further, the distance D1 between the inner circumferential surface of the first conveying belt 51 and the outer face of the cover 35 is smaller than the radius D2 of the driven roller 55 (or of the driven roller 54). In addition, the axial center of the driven roller 55 or the driven roller 54 is located at a position to separate from the cover 35 relative to the inner circumferential surface of the first conveying belt 51 stretched between the driven rollers 54 and 55. Further, the cover 35 is arranged parallel to the inner circumferential surface of the first conveying belt 51 that faces the cover 35. Accordingly, since the inner circumferential surface of the first conveying belt 51 is disposed close to the cover 35, the cooling device 9F can reduce in size in the direction intersecting the sheet conveying direction. Further, the outer face of the cover 35 is flat or curved, and therefore the inner circumferential surface of the first conveying belt 51 can be disposed closer to the cover 35 when compared with the configuration of the cooling device 9B illustrated in FIGS. 11A and 11B.

It is to be noted that the cover 35 can be applied to the heat sink (e.g., the first cooler 30) according to each of the above-described embodiments.

Figure 28A:
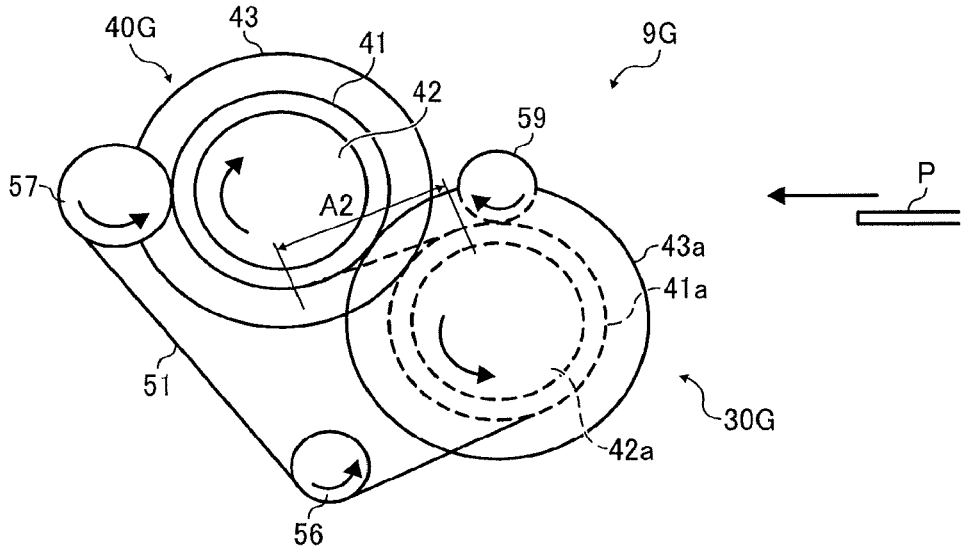
FIG. 28A is a side view illustrating a front of a comparative cooling device to the cooling device of FIG. 11, viewed from the front of the image forming apparatus.
Figure 28B:
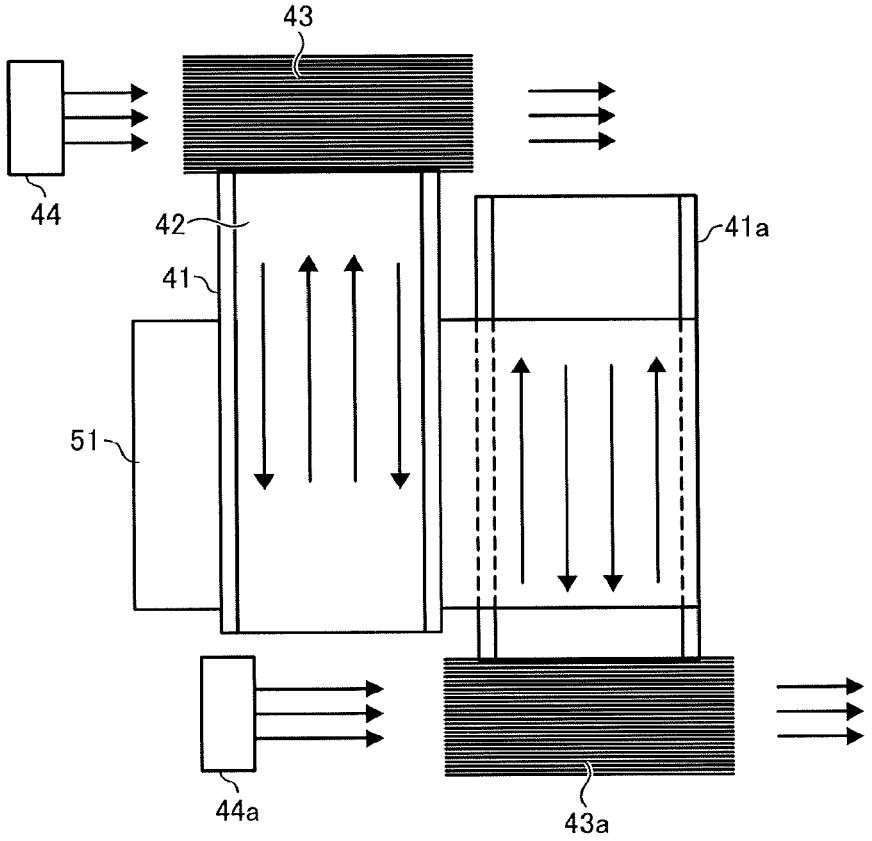
FIG. 28B is a top view illustrating the comparative cooling device of FIG. 28A, viewed from the top of the image forming apparatus.

FIG. 28A is a side view illustrating a front of a comparative cooling device 9G to the cooling device 9 of FIGS. 2A and 2B, viewed from the front of the image forming apparatus 1000. FIG. 28B is a top view illustrating the comparative cooling device 9G of FIG. 28A, viewed from the top of the image forming apparatus 1000.

The cooling device 9G of FIGS. 28A and 28B includes at least a first cooler 30G and a second cooler 40G. The first cooler 30G cools the back face side of the recording medium P (i.e., the non-image forming face in the single-side printing job) and the second cooler 40G cools the front face side of the recording medium P (i.e., the image forming face in the single-side printing job). The first cooler 30G having the first heat absorbing surface 41*a* and the second cooler 40G having the second heat absorbing face 41 are heat pipe rollers having the same shape. Specifically, the first cooler 30 includes the first heat absorbing surface 41*a* that contacts the recording medium P via the first conveying belt 51 that functions as a first belt. The second cooler 400 includes the second heat absorbing face 41 that directly contacts the recording medium P.

In addition, both the first cooler 300 and the second cooler 40G include a fluid passage through which fluid (liquid) flows.

In the comparative cooling device 9A in FIG. 3, the fin 43 and the fin 43*a* are disposed at the far side of the cooling device 9A (the far side on the drawing sheet) from the second conveying belt 58 and adjacent to each other in the sheet conveying direction. Therefore, as the heat absorbing surface 41 and the heat absorbing surface 41*a* are disposed closer to each other in the sheet conveying direction, the fin 43 and the fin 43*a* interfere each other.

By contrast, as illustrated in FIG. 28B, while the second cooler 40G is disposed to cause the fin 43 to be disposed the far side of the image forming apparatus 1000, the first cooler 300 is disposed to cause the fin 43*a* to be disposed to the near side of the image forming apparatus 1000. Therefore, when compared with the comparative cooling device 9A illustrated in FIG. 3, the cooling device 9G illustrated in FIGS. 28A and 28B can locate the first heat absorbing surface 41*a* and the second heat absorbing face 41 closer to each other without causing the fin 43 of the second cooler 40G and the fin 43*a* of the first cooler 30G to interfere with each other.

However, as illustrated in FIG. 28B, the fin 43 and the fin 43*a* are disposed the front and back of the cooling device 9G across the first conveying belt 51, and therefore the size of the cooling device 9G increases in a direction from the front to the back of the cooling device 9G. Further, the fin 43 has a diameter greater than respective diameters of the heat absorbing surfaces 41 and 41*a*. Therefore, the operability of the cooling device 9G may be degraded when the heat absorbing surfaces 41 and 41*a* are supported by the frame. For example, the heat absorbing surface 41 is inserted into a supporting hole of the frame downwardly from the upper part in FIG. 28B and is fixed to the frame. The heat absorbing surface 41*a* is inserted into a supporting hole of the frame upwardly from the lower part in FIG. 28B and is fixed to the frame. Accordingly, the direction to fix the heat absorbing surface 41 and the direction to fix the heat absorbing surface 41*a* are opposite to each other.

By contrast, as the above-described embodiments of the cooling devices 9, 9B through 9F, and 9L, the cooling methods are different between the first cooler 30 and the second cooler 40. Therefore, not only the size from the front side to the rear side of each of the cooling devices 9, 9B through 9F, and 9L or the housing 200 of the image forming apparatus 1000 but also the size in the horizontal direction (i.e., the size in the sheet conveying direction) can be reduced.

The recording medium P is not limited to a recording medium used in an electrophotographic image forming apparatus. For example, a recording medium used in an inkjet image forming apparatus (that is, a sheet-type recording medium or a roll-type recording medium) can be applied to this disclosure.

Figure 29:
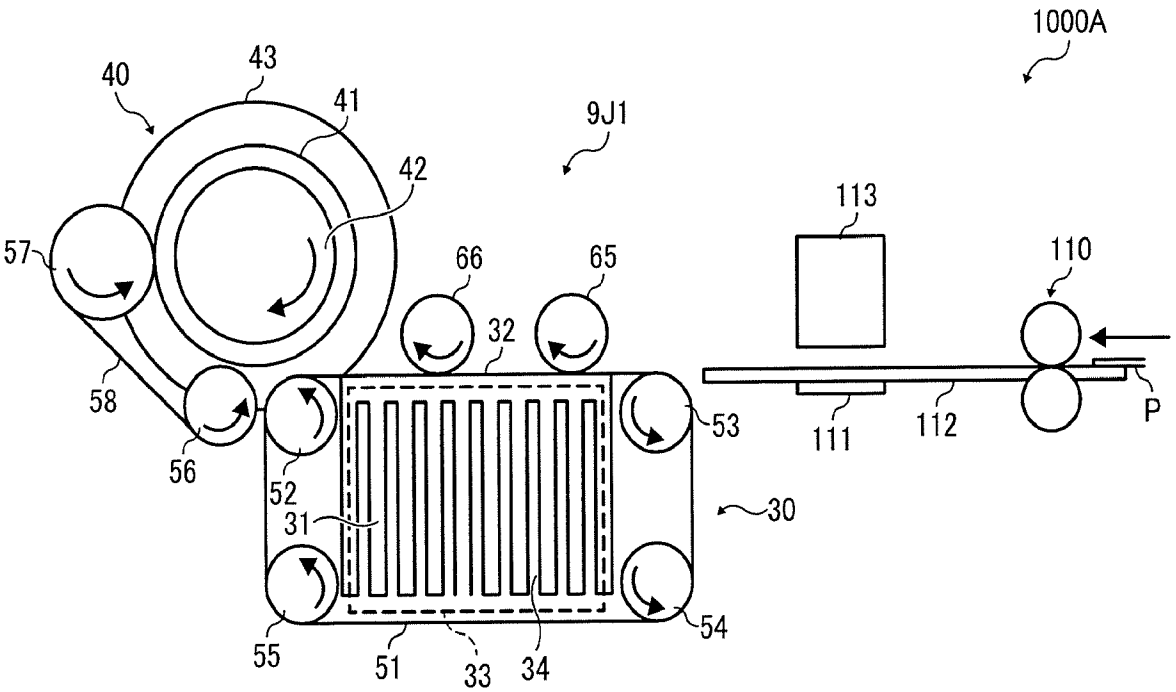
FIG. 29 is a schematic view illustrating an image forming apparatus employing an inkjet recording method with a first belt.

FIG. 29 is a schematic view illustrating an image forming apparatus 1000A employing an inkjet recording method.

In the image forming apparatus 1000A, as the recording medium P is conveyed by a sheet conveying body 110, liquid is sprayed from an inkjet head 113 onto the recording medium P, so that an image is formed. A heating body 111 such as an electric heater is disposed below an exposure glass 112 onto which the recording medium P is guided. The heating body 111 heats the recording medium P via the exposure glass 112. The heating body 111 forcedly heats solvent ink drops landed on the surface of the recording medium P and causes highly permeable organic solvents included in the solvent ink drops to quickly evaporate. Then, the recording medium P is cooled by a cooling device 9J1 that corresponds to any of the cooling devices 9, 9B through 9F, and 9L according to the above-described embodiments. It is to be noted that the heating body may be disposed downstream to the inkjet head 113 in the sheet conveying direction.

Same as the configuration illustrated in FIG. 29, the recording medium P is not limited to a recording medium used in an electrophotographic image forming apparatus. For example, a recording medium used in an inkjet image forming apparatus illustrated in FIG. 30 (that is, a sheet-type recording medium or a roll-type recording medium) can be applied to this disclosure.

Figure 30:
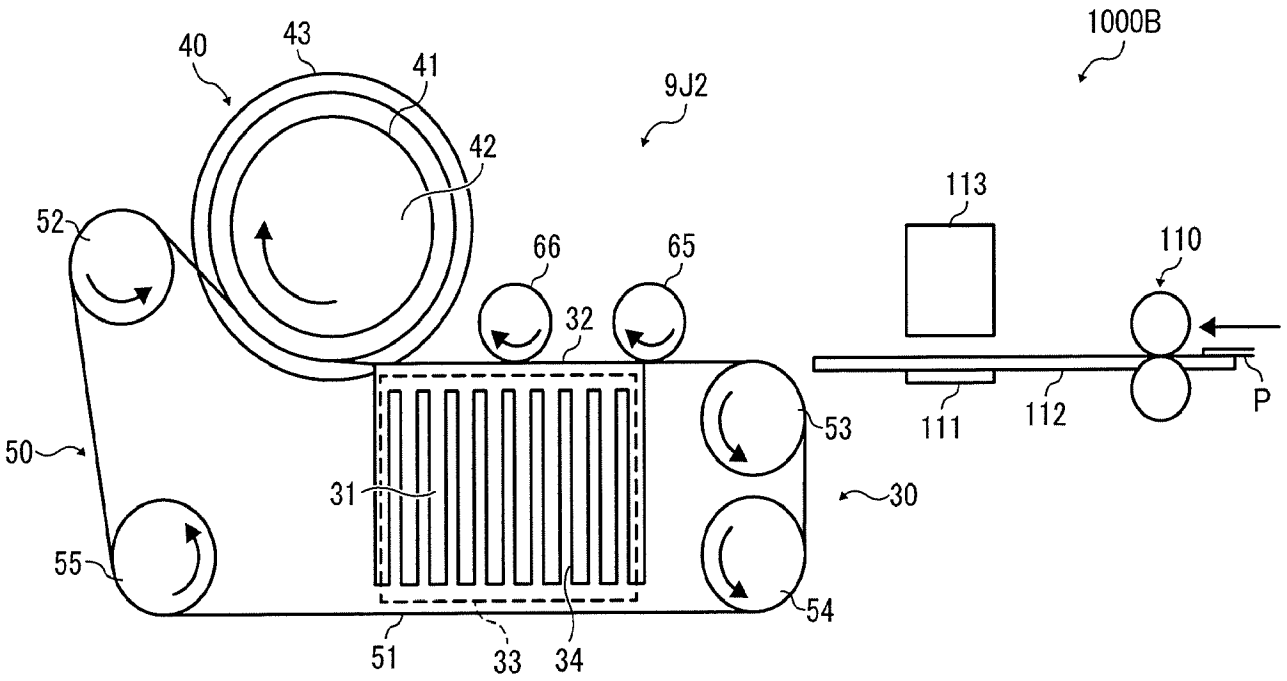
FIG. 30 is a schematic view illustrating an image forming apparatus employing an inkjet recording method with the first belt and a second belt.

FIG. 30 is a schematic view illustrating an image forming apparatus 1000B employing an inkjet recording method.

The elements or devices of the image forming apparatus 1000B illustrated in FIG. 30 are similar in structure and functions to the elements or devices of the image forming apparatus 1000A, except the image forming apparatus 1000A employs two belts (the first conveying belt 51 and the second conveying belt 58) included in the cooling device 9J1 that corresponds to any of the cooling devices 9, 9B through 9F, and 9L while the image forming apparatus 1000B employs one belt (the first conveying belt 51) in a cooling device 9J2 that corresponds to any of the cooling devices 9, 9B through 9F, and 9L. Therefore, the elements or devices of the image forming apparatus 1000B may be denoted by the same reference numerals as those of the image forming apparatus 1000A and the descriptions thereof are omitted or summarized.

Further, the recording medium is not limited to be conveyed in the image forming apparatus. For example, this disclosure can apply a recording medium that is conveyed in any device employing cooling processes to perform after the recording medium is heated (for example, an electronic substrate or a printed circuit board).

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A cooling device comprising:

a first cooler configured to cool a first face of a recording medium and a second cooler configured to cool a second face of the recording medium, the first cooler including a first heat absorbing face configured to: i) contact an inner circumferential surface of a belt, ii) face the first face of the recording medium via the belt, and iii) include a first liquid flowing passage therein, and the second cooler including a second heat absorbing face disposed facing the second face of the recording medium and including a second liquid flowing passage, wherein a shape of the second heat absorbing face of the second cooler is different from a shape of the first heat absorbing face of the first cooler.

2. The cooling device according to claim 1, wherein the first liquid flowing passage of the first cooler and the second liquid flowing passage of the second cooler are formed in a direction intersecting a sheet conveying direction of the recording medium.

3. The cooling device according to claim 1, wherein a width of the first heat absorbing face of the first cooler extends in a sheet conveying direction of the recording medium, and wherein the second heat absorbing face of the second cooler has either one of a shape to change the sheet conveying direction after the recording medium has passed the first heat absorbing face of the first cooler and a shape to change the sheet conveying direction toward the first heat absorbing face disposed in a direction different from an entering direction of the recording medium.

4. The cooling device according to claim 1, wherein the first cooler comprises:

multiple heat dissipating bodies extending in a direction separating from a recording media conveying passage with respect to the first heat absorbing face; and an airflow generator configured to generate airflow passing through the first liquid flowing passage between the multiple heat dissipating bodies, and wherein the second cooler comprises:

a rotary body corresponding to the second heat absorbing face;

a container to contain a refrigerant inside the rotary body; and a heat dissipating body to liquefy the refrigerant evaporated by heat of the recording medium and stored in the container due to thermal exchange.

5. The cooling device according to claim 4, wherein an outer circumferential surface of the heat dissipating body of the second cooler is located farther toward a shaft center of the rotary body than an outer circumferential surface of the rotary body, and wherein the first cooler is partly disposed closer toward a shaft center of the heat dissipating body of the second cooler from the outer circumferential surface of the heat dissipating body of the second cooler.

6. The cooling device according to claim 1, wherein the first cooler and the second cooler are disposed shifted from each other in the sheet conveying direction.

7. The cooling device according to claim 1, wherein the recording medium having an image on an image forming face and no image on a non-image forming face is conveyed to a heating device of an image forming apparatus, wherein the heating device fixes the image to the image forming face of the recording medium, wherein the first cooler is disposed on the opposite side of the image forming face of the recording medium and the first heat absorbing face is configured to slide on an inner circumferential surface of the belt, wherein the second cooler is disposed on the opposite side of the first cooler across a recording media conveying passage, and wherein the second cooler is a rotary body configured to rotate while in contact with the recording medium.

8. The cooling device according to claim 7, wherein the second cooler is disposed at a downstream side from the first cooler in the sheet conveying direction.

9. The cooling device according to claim 1, further comprising a belt driving body to drive the belt, wherein the belt has an inner circumferential surface configured to slide on the first heat absorbing face and an outer circumferential surface configured to hold and convey the recording medium together with the second heat absorbing face.

10. The cooling device configured to claim 9, wherein the first heat absorbing face includes a width extending in a sheet conveying direction and has a shape projecting relative to an upstream end and a downstream end in the sheet conveying direction, and wherein a contact start position of the belt and the second heat absorbing face of the second cooler at an upstream side of the sheet conveying direction is located on an extension of a virtual line connecting the upstream end and the downstream end of the first heat absorbing face in the sheet conveying direction.

11. The cooling device according to claim 9, wherein the first heat absorbing face has a curved shape having a center projecting relative to an upstream end and a downstream end in a sheet conveying direction, and wherein the second cooler includes a roller shape.

12. The cooling device according to claim 11, further comprising:

a sheet conveying body disposed upstream from the first cooler in a sheet conveying direction and including a rotary body configured to hold and convey the recording medium after the recording medium has passed a heating device; and a sheet transfer guide disposed between the sheet conveying body and the first cooler, the sheet transfer guide including a guide portion having a guide face inclined upwardly from an upstream side to a downstream side of the sheet conveying direction.

13. The cooling device according to claim 1, further comprising a sheet conveying body disposed upstream from the first cooler in a sheet conveying direction and including a rotary body configured to hold and convey the recording medium after the recording medium has passed a heating device, wherein a speed of rotation of the second cooler is greater than a speed of rotation of the sheet conveying body.

14. The cooling device according to claim 13, further comprising a sheet transfer guide disposed between the sheet conveying body and the first cooler, the sheet transfer guide including a guide portion having a guide face inclined upwardly from an upstream side to a downstream side of the sheet conveying direction.

15. The cooling device according to claim 1, wherein, when a direction from an upstream end to a downstream end of the first heat absorbing face in a sheet conveying direction represents a width direction, the downstream end of the first heat absorbing face is located within a width of the second cooler in the width direction.

16. The cooling device according to claim 1, wherein the second cooler includes a rotary body configured to be rotated with movement of the belt and configured to hold and convey the recording medium together with the second heat absorbing face and the belt, and wherein an outer surface of the second heat absorbing face includes a coat layer.

17. The cooling device according to claim 1, wherein a contact width in a sheet conveying direction where the first heat absorbing face and the belt contact to each other is greater than a contact width where the second heat absorbing face and the belt contact to each other.

18. An image forming apparatus comprising:

a heating device configured to fix a toner image to a recording medium; and the cooling device according to claim 1, configured to cool the recording medium conveyed from the heating device.

* * * * *